US012642402B2

(12) United States Patent
Jang et al.

(10) Patent No.: US 12,642,402 B2
(45) Date of Patent: Jun. 2, 2026

(54) CLEANER STATION, CLEANER SYSTEM, AND CONTROL METHOD THEREFOR

(71) Applicant: LG ELECTRONICS INC., Seoul (KR)

(72) Inventors: Jaewon Jang, Seoul (KR); Sangik Lee, Seoul (KR); Kietak Hyun, Seoul (KR); Hyunsup Song, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 420 days.

(21) Appl. No.: 18/271,906

(22) PCT Filed: Jan. 13, 2022

(86) PCT No.: PCT/KR2022/000627

§ 371 (c)(1),
(2) Date: Jul. 12, 2023

(87) PCT Pub. No.: WO2022/154507

PCT Pub. Date: Jul. 21, 2022

(65) Prior Publication Data

US 2024/0065499 A1 Feb. 29, 2024

(30) Foreign Application Priority Data

Jan. 13, 2021 (KR) ..... 10-2021-0004353

(51) Int. Cl.
*A47L 9/00* (2006.01)
*A47L 9/14* (2006.01)
(Continued)

(52) U.S. Cl.
CPC ..... *A47L 9/0072* (2013.01); *A47L 9/0063* (2013.01); *A47L 9/149* (2013.01); *A47L 9/16* (2013.01); *A47L 9/1683* (2013.01); *A47L 9/2873* (2013.01)

(58) Field of Classification Search
CPC ..... A47L 2201/02; A47L 2201/024; A47L 9/0063; A47L 9/1683; A47L 9/1691; A47L 9/2873; A47L 9/149; A47L 9/106
See application file for complete search history.

(56) References Cited

U.S. PATENT DOCUMENTS 9,808,135 B2 11/2017 Mantyla et al.
10,464,746 B2 11/2019 Conrad
(Continued)

FOREIGN PATENT DOCUMENTS

CN 109758031 A 5/2019
CN 211911489 U 11/2020
(Continued)

OTHER PUBLICATIONS

Machine translation: KR-20200074054-A; Kim et al. (Year: 2020).*

*Primary Examiner* — Natasha N Campbell
(74) *Attorney, Agent, or Firm* — Birch, Stewart, Kolasch & Birch, LLP

(57) ABSTRACT

A method for controlling a cleaner station includes a dust bin fixation step of fixing a dust bin of a cleaner when the cleaner is coupled to a cleaner station, a door opening step of rotating a door of the cleaner station to open a dust passage hole when the dust bin is fixed, a dust collecting step of operating a dust collection motor of the cleaner station in a state in which the door is open, to collect the dust in the dust bin, and an additional dust collecting step of maintaining the flow rate of air passing through the dust passage hole while changing the velocity of the air, after the dust collecting step, thereby suctioning dirt remaining in the dust bin and around a filter.

10 Claims, 18 Drawing Sheets

(51) Int. Cl.
*A47L 9/16* (2006.01)
*A47L 9/28* (2006.01)

(56) References Cited

U.S. PATENT DOCUMENTS

| | | | | |
|---|---|---|---|---|
| 2015/0135470 | A1 | 5/2015 | Mantyla et al. | |
| 2020/0405107 | A1* | 12/2020 | Na | A47L 9/2884 |

FOREIGN PATENT DOCUMENTS

| | | | | | |
|---|---|---|---|---|---|
| DE | 10 2013 103 086 | A1 | | 10/2014 | |
| KR | 10-2020-0073975 | A | | 6/2020 | |
| KR | 10-2020-0074055 | A | | 6/2020 | |
| KR | 20200074054 | A | * | 6/2020 | A47L 9/2873 |
| KR | 10-2021-0002057 | A | | 1/2021 | |

* cited by examiner

[FIG. 1]
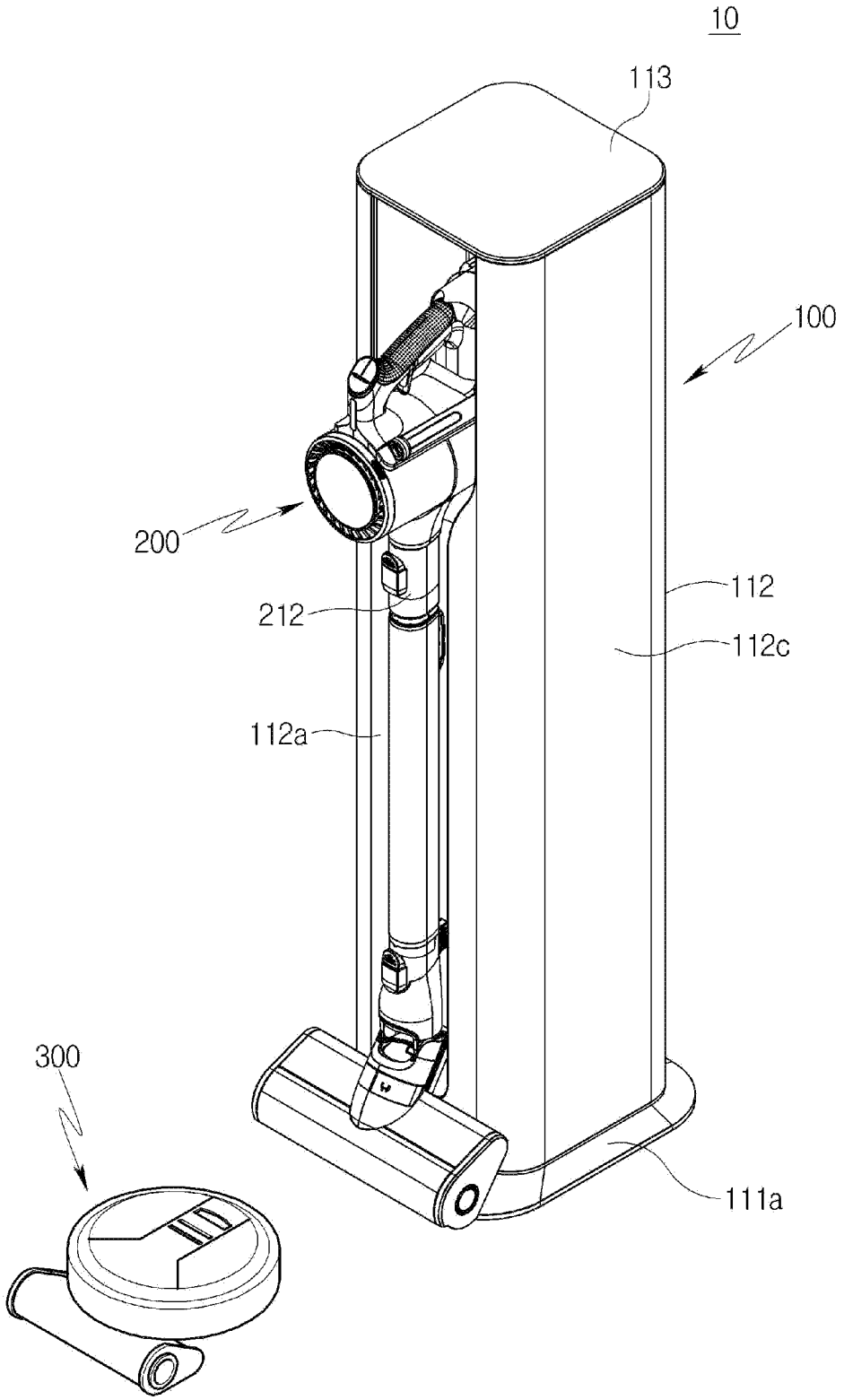

[FIG. 2]
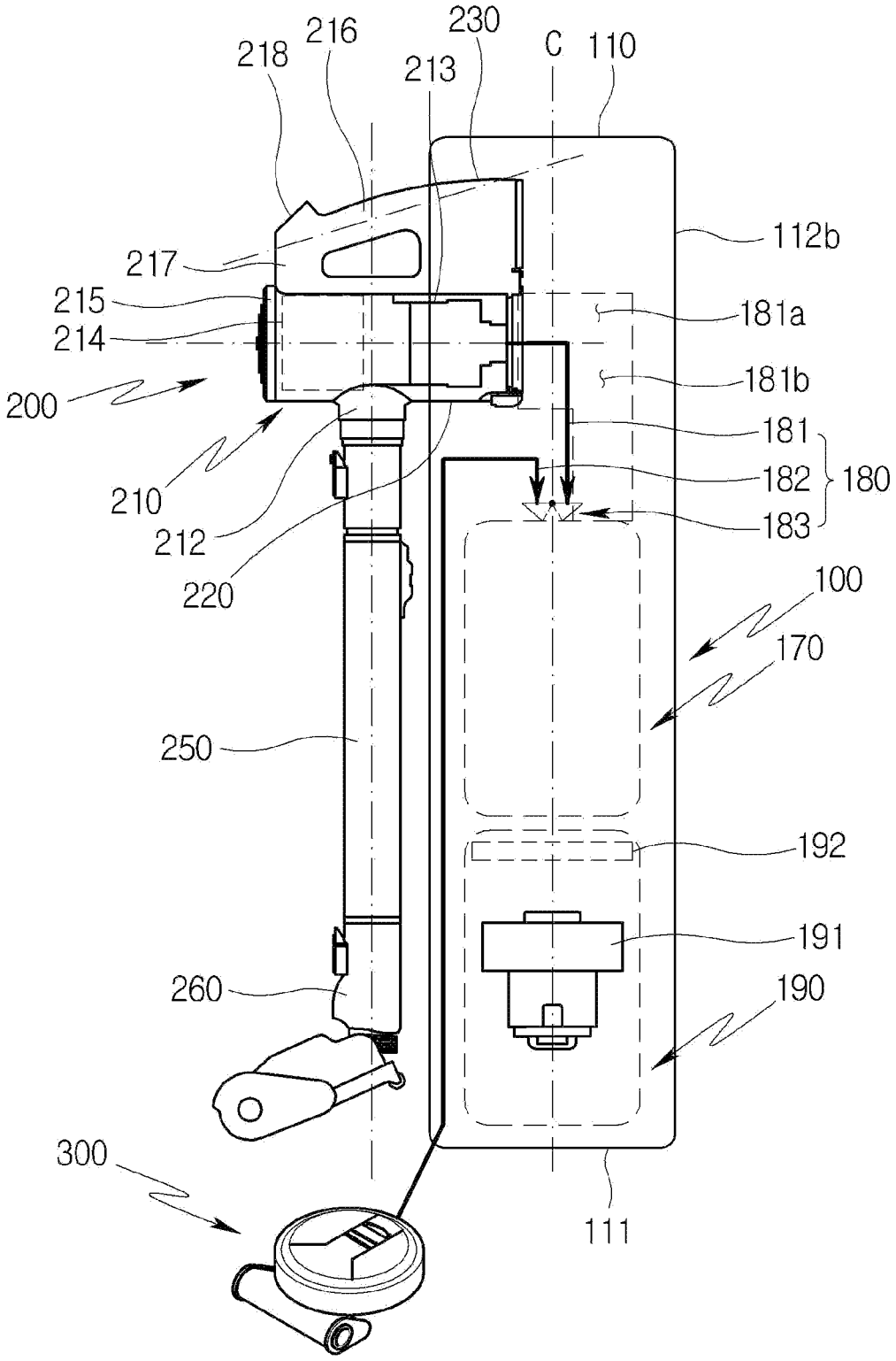

[FIG. 3]
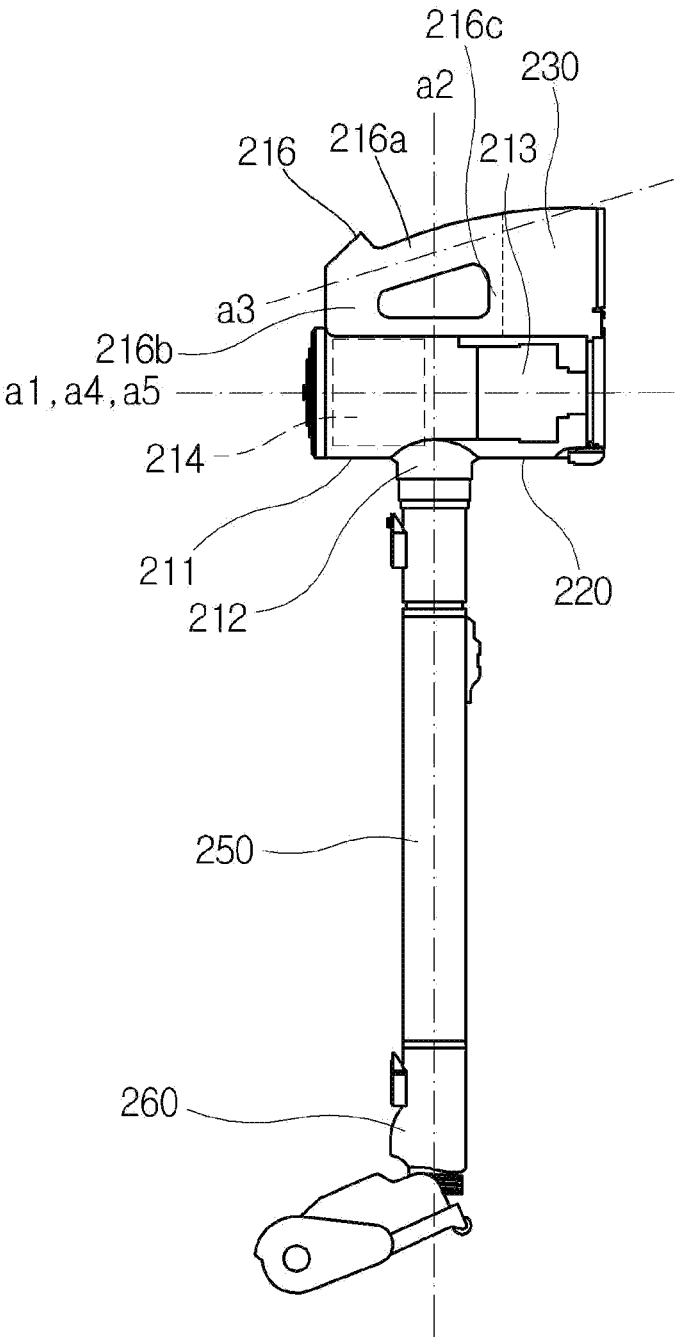

[FIG. 4]
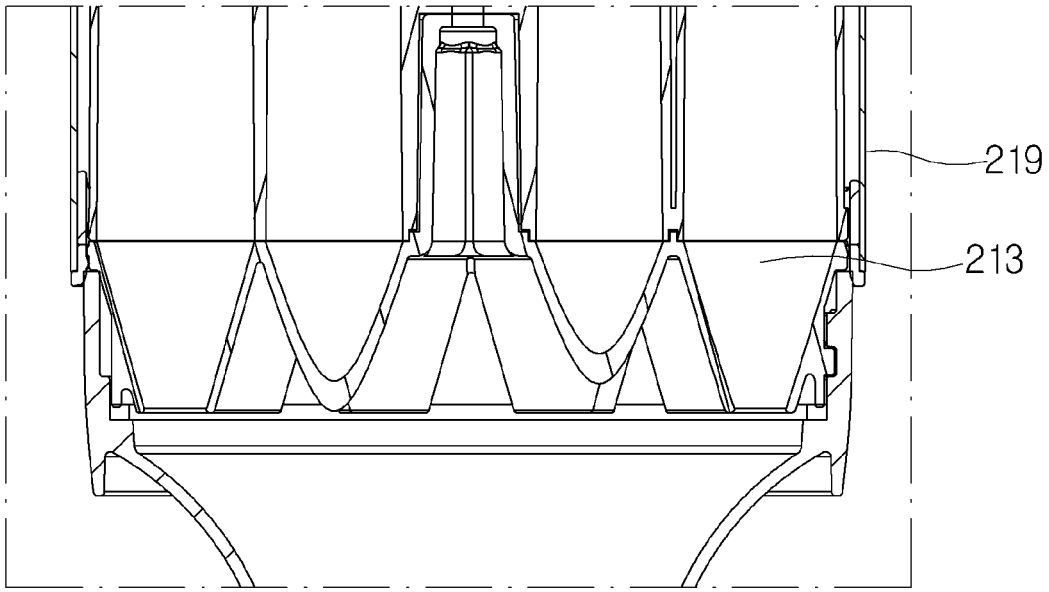

[FIG. 5]
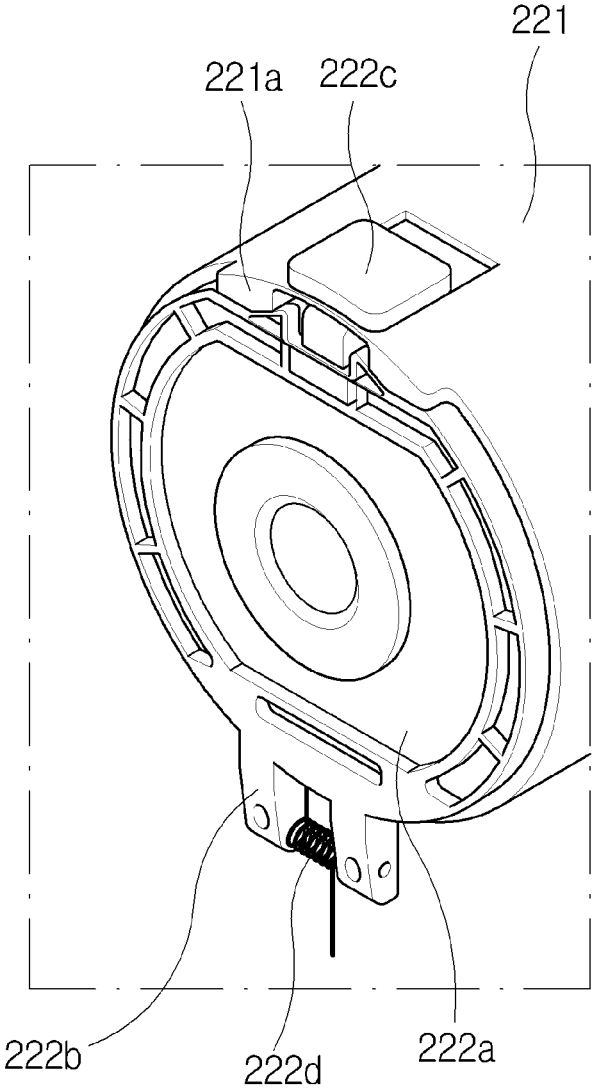

[FIG. 6]
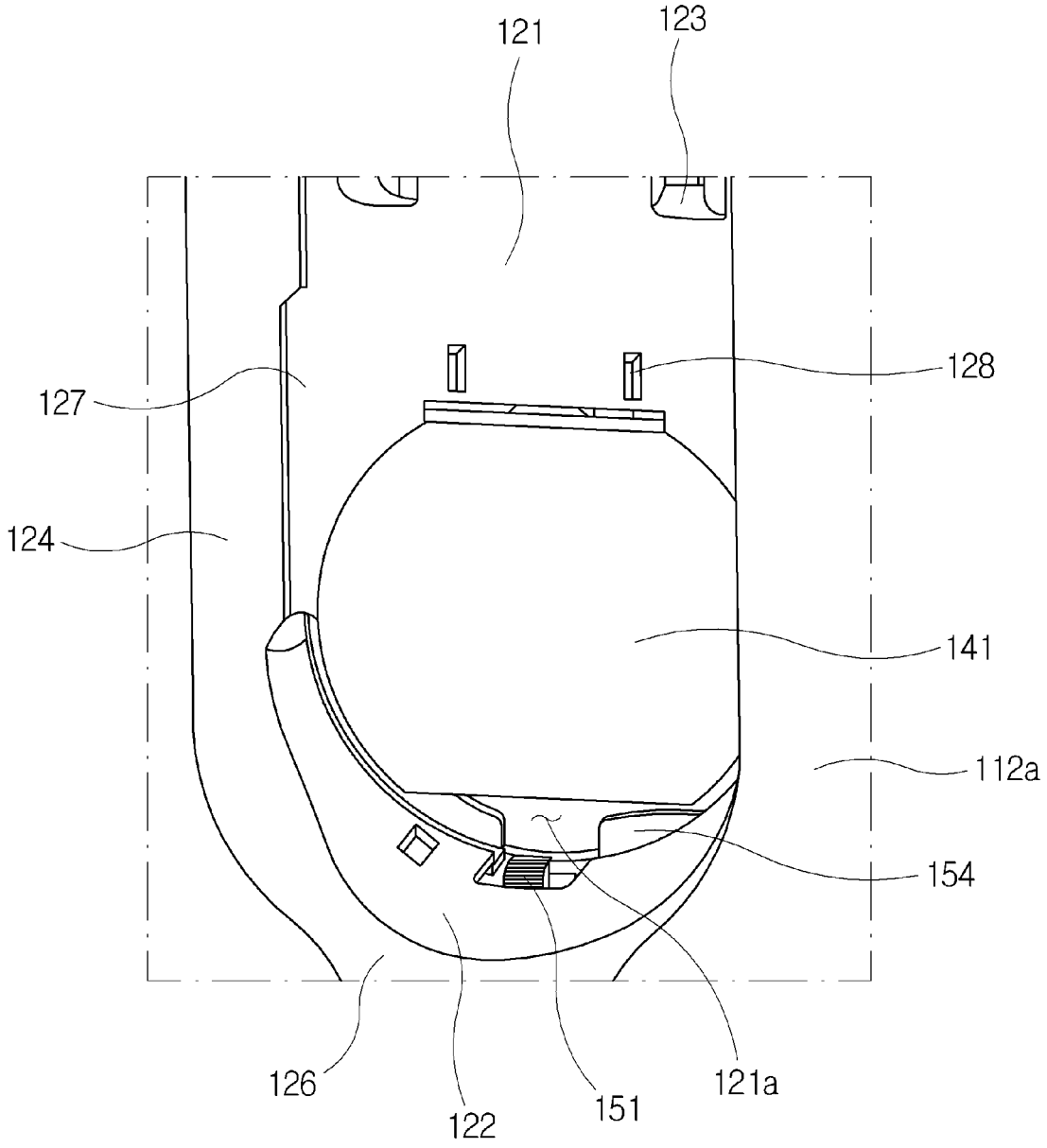

[FIG. 7]
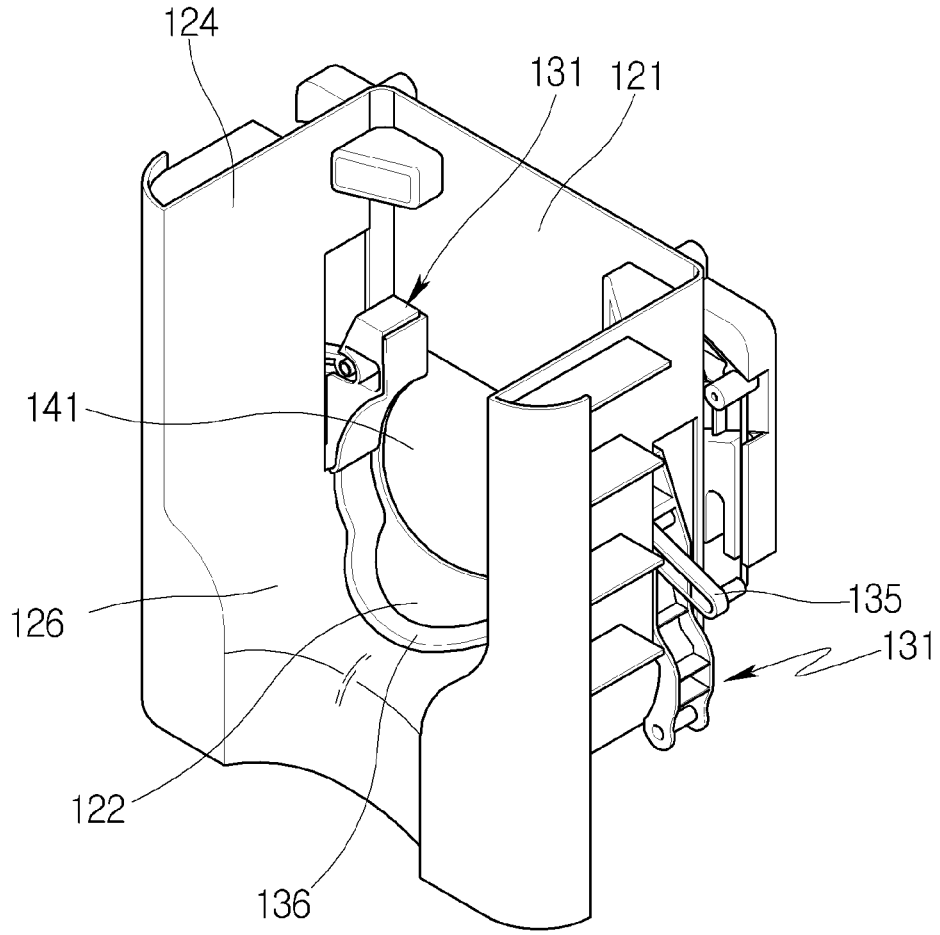

[FIG. 8]
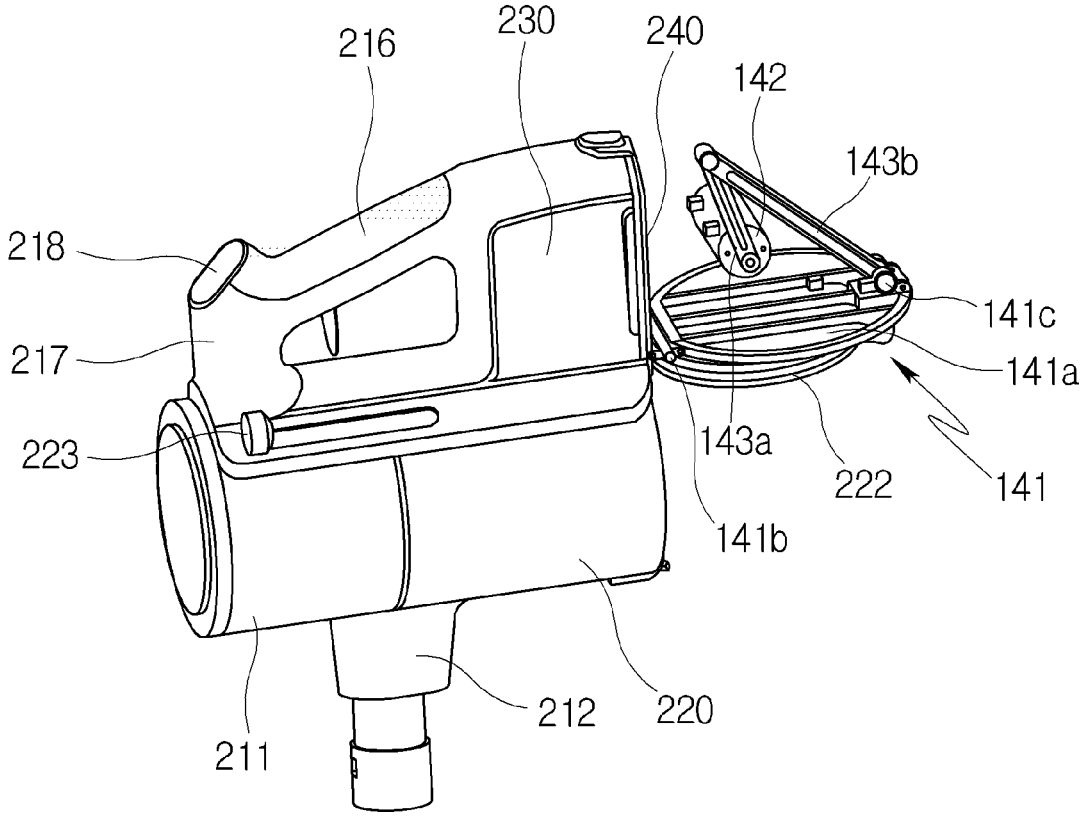

[FIG. 9]
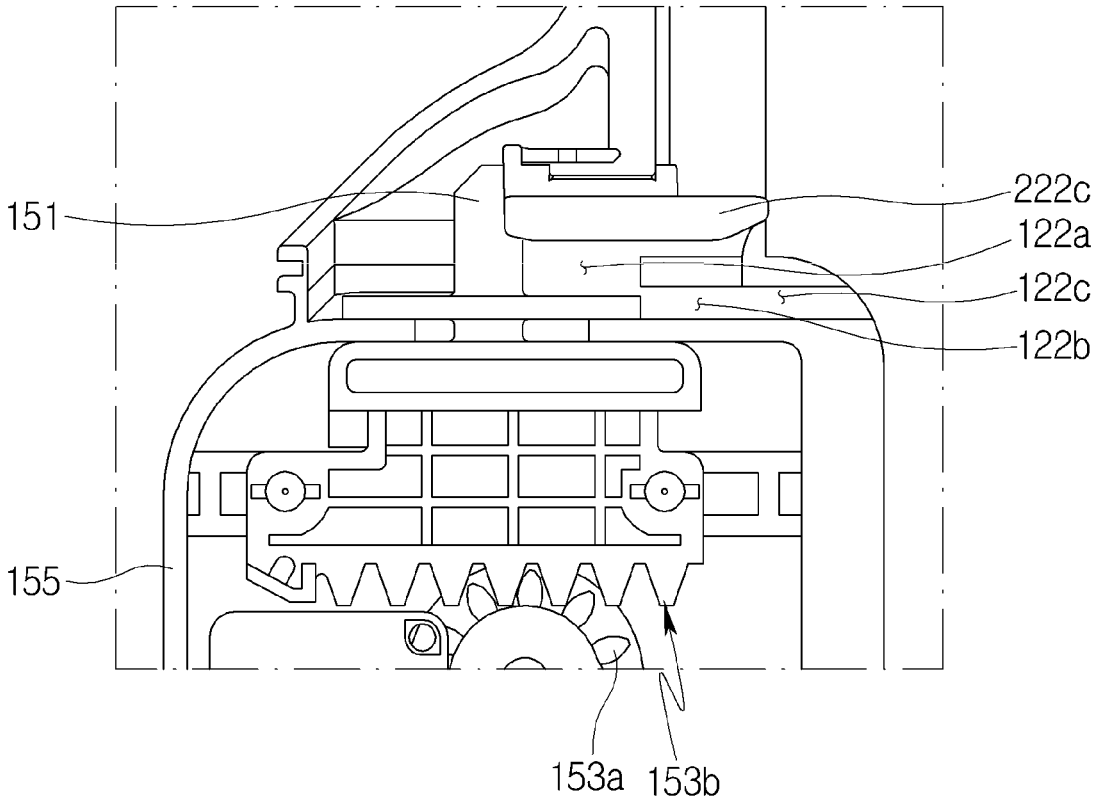

[FIG. 10]
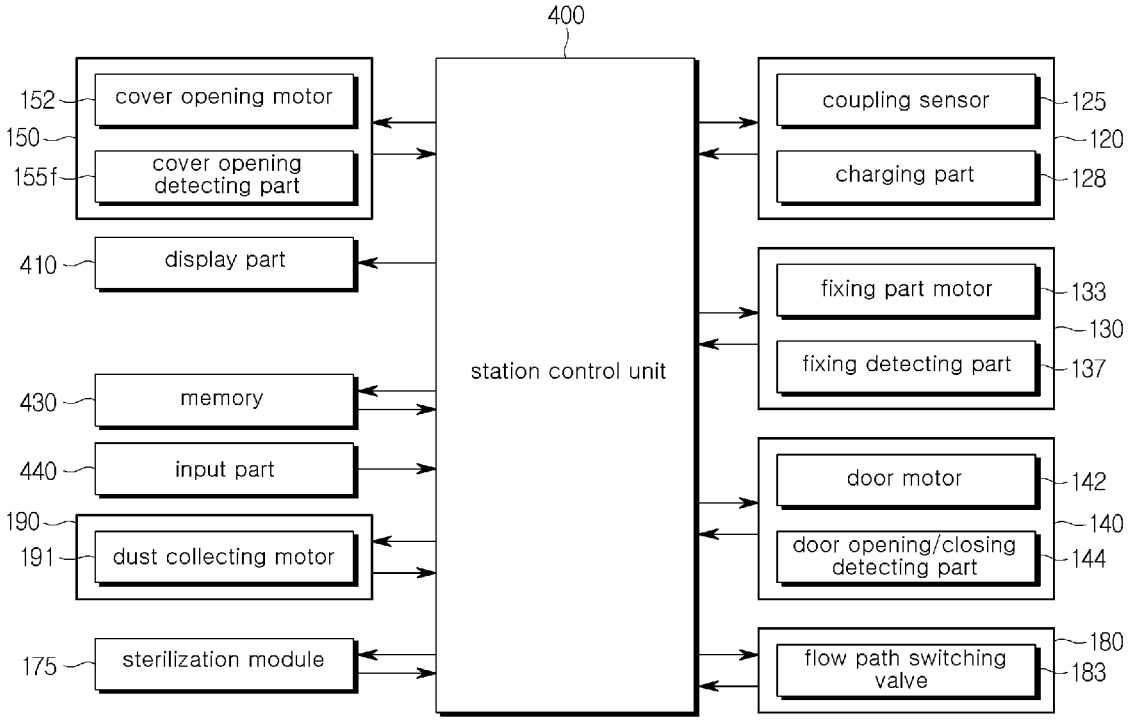

[FIG. 11]
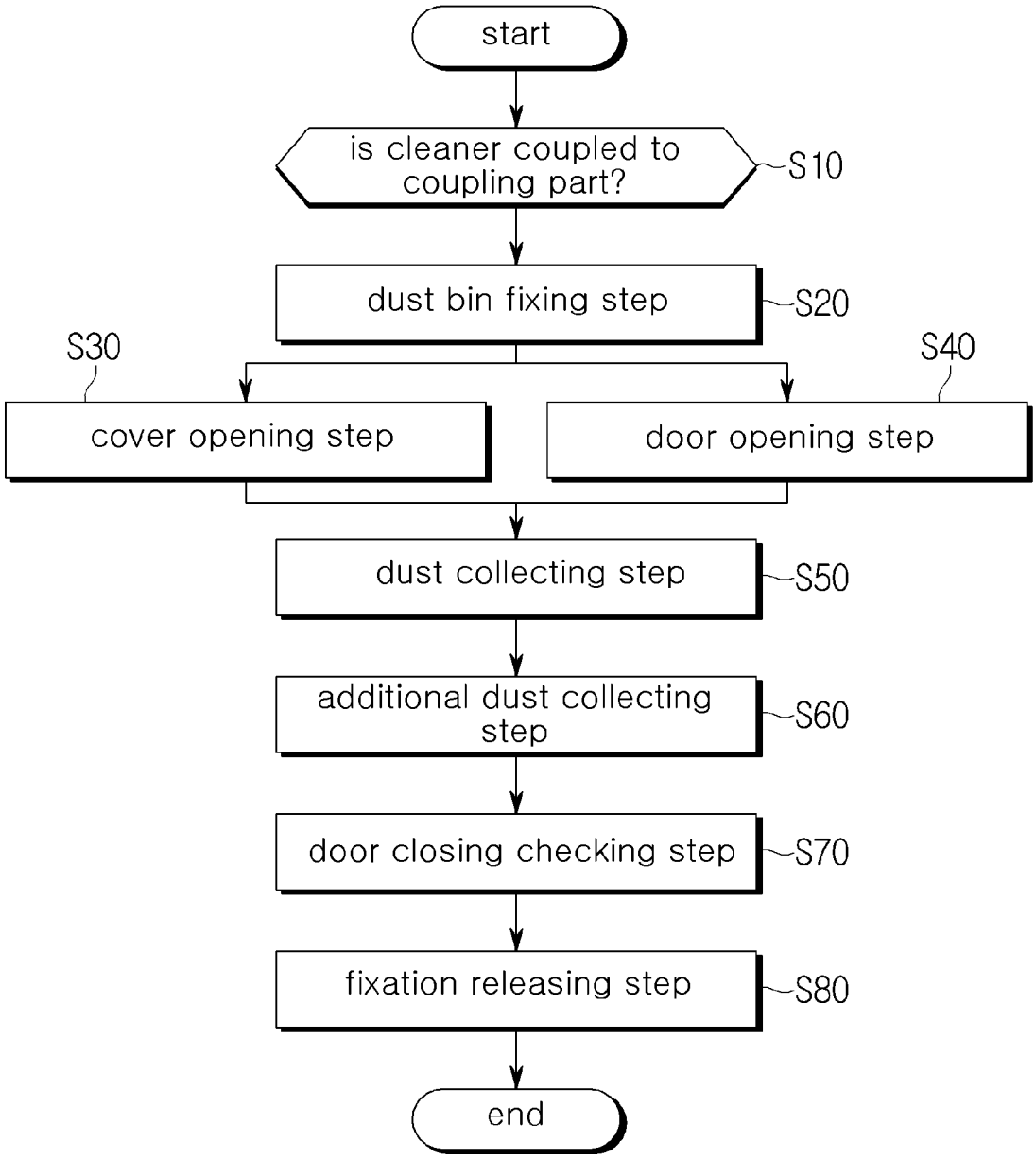

[FIG. 12]
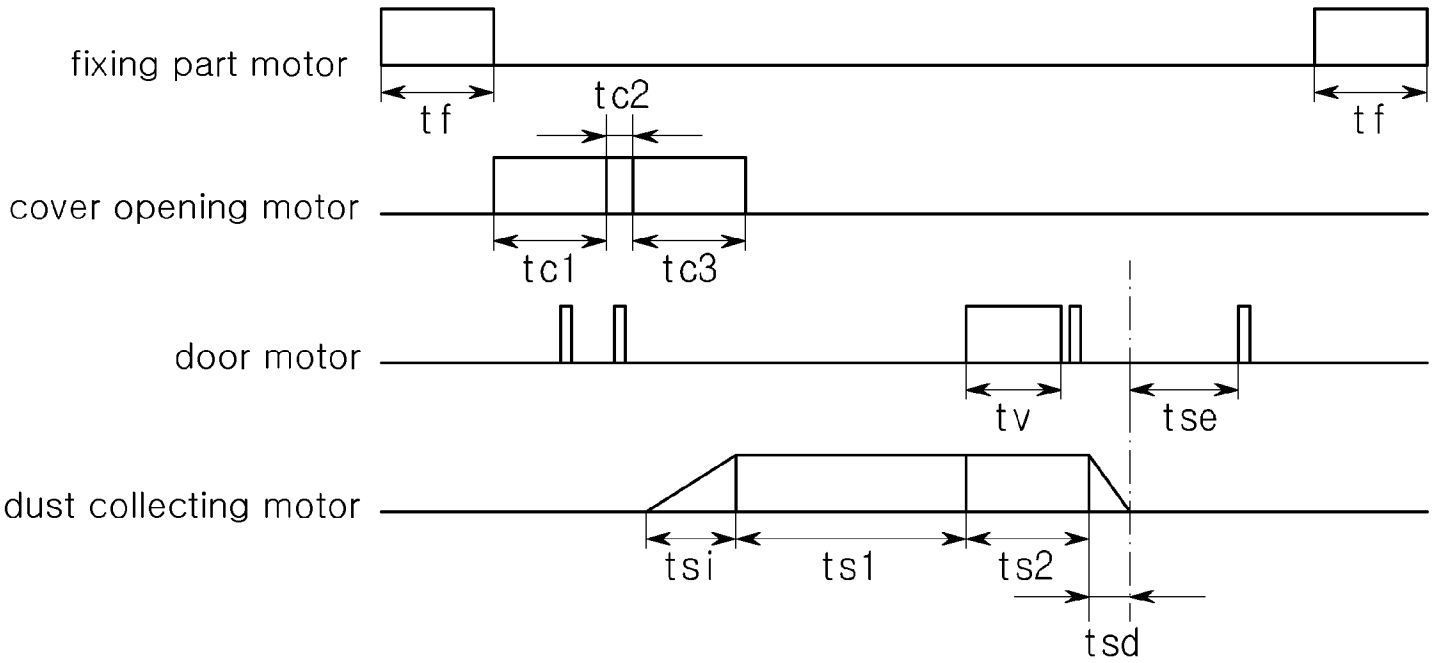

[FIG. 13a]
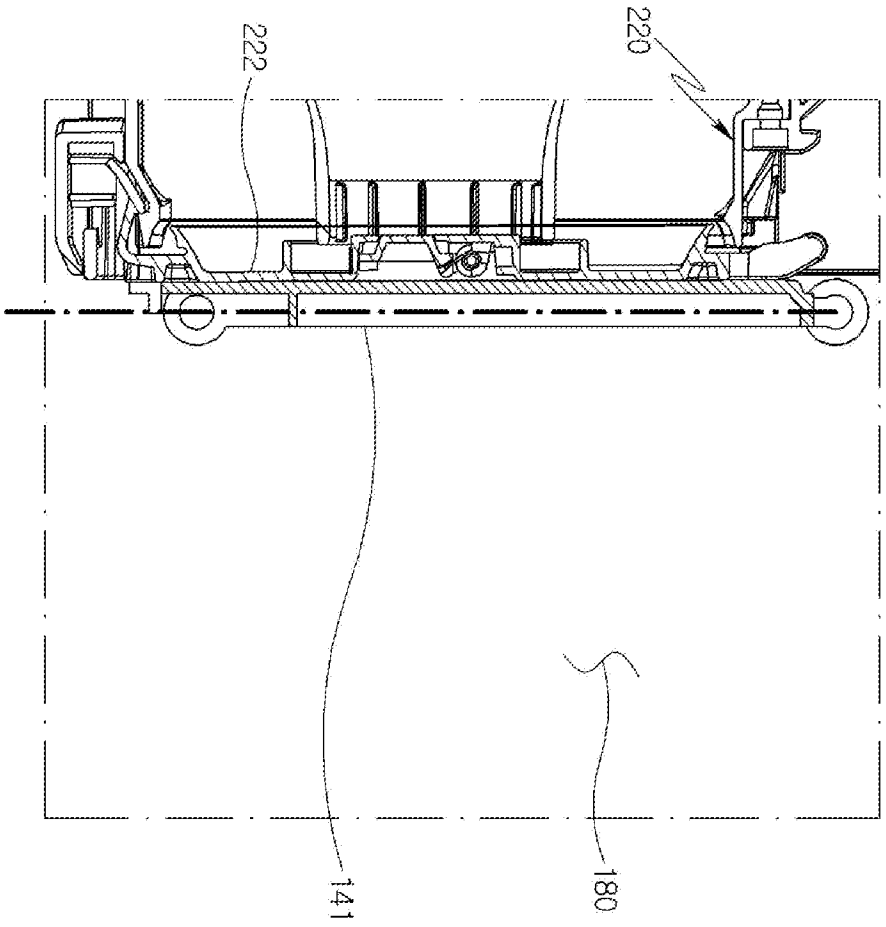

[FIG. 13b]
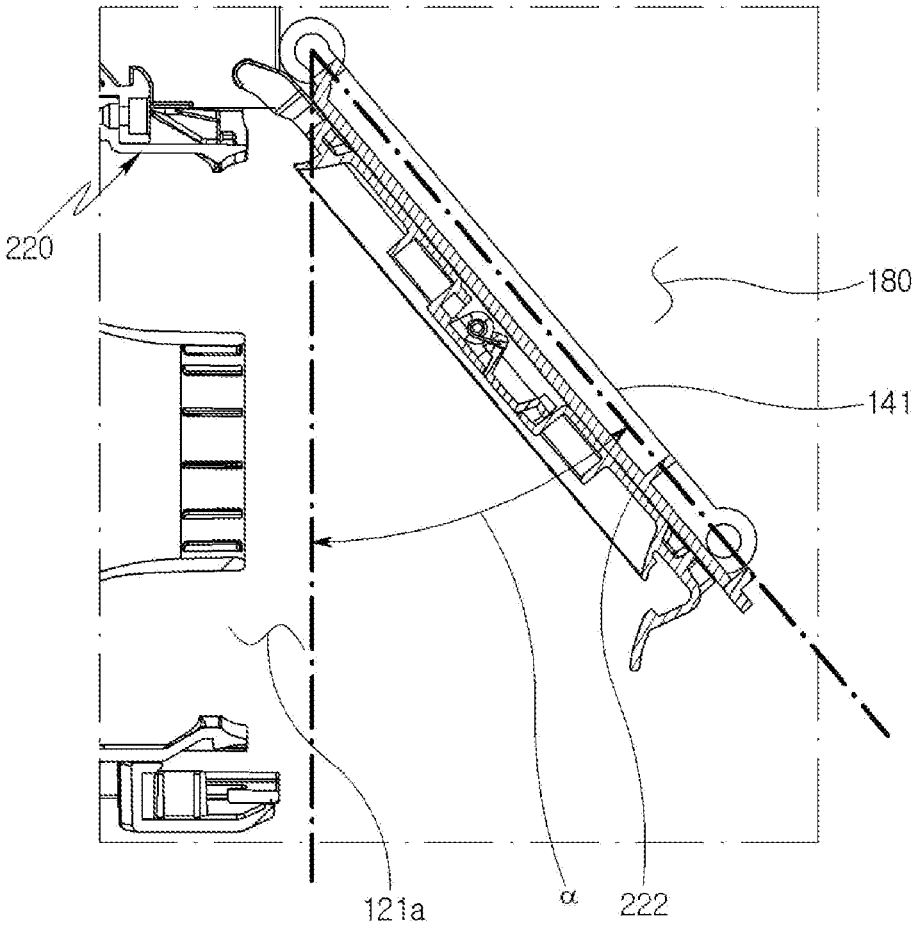

[FIG. 13c]
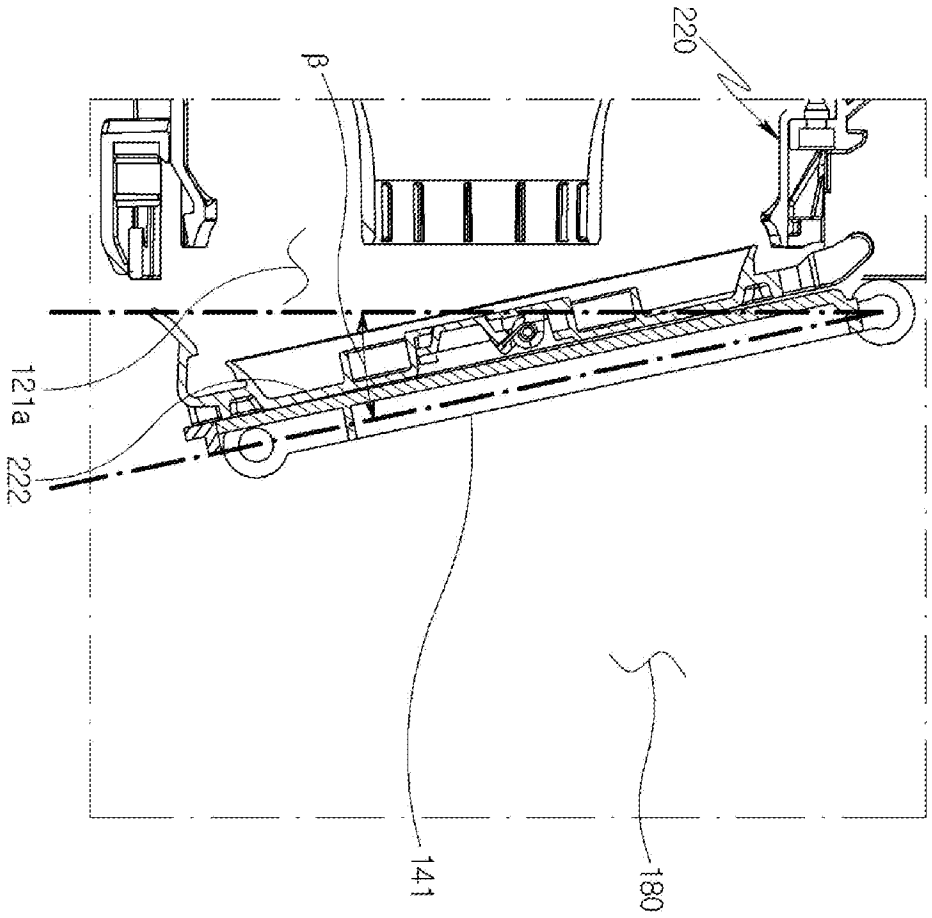

[FIG. 14]
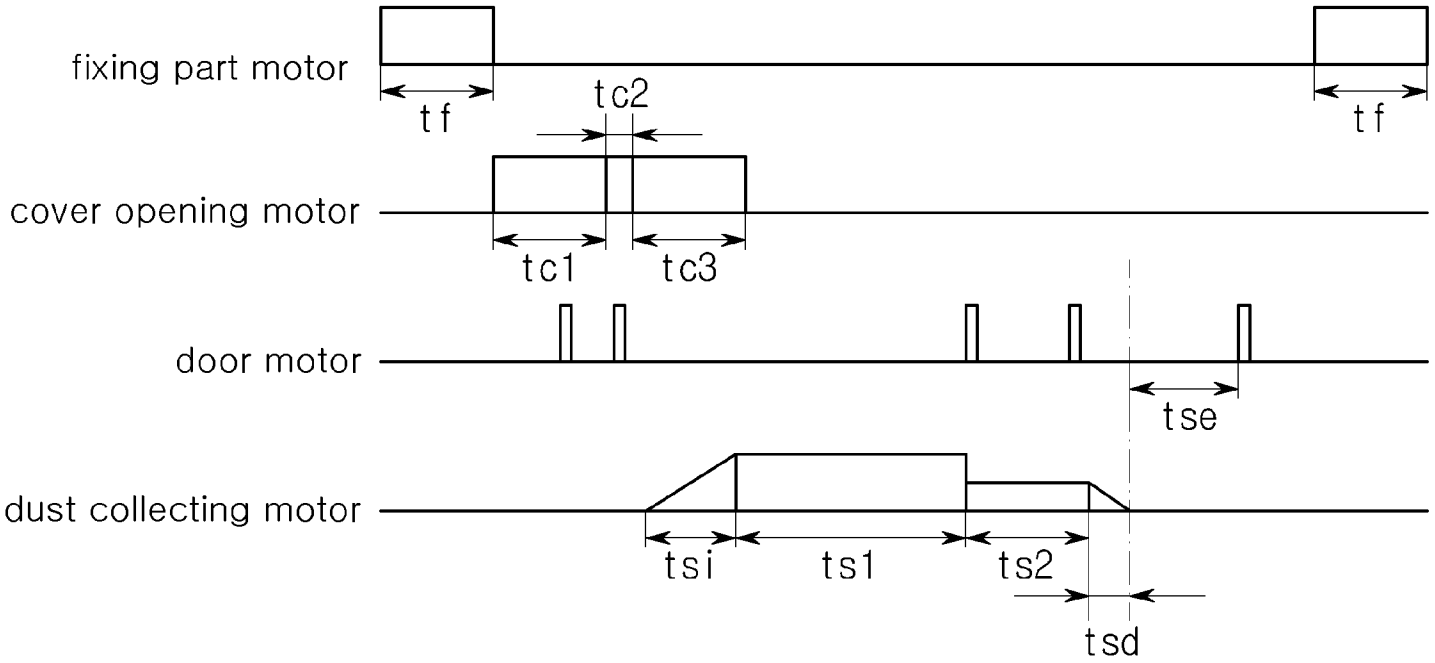

[FIG. 15]
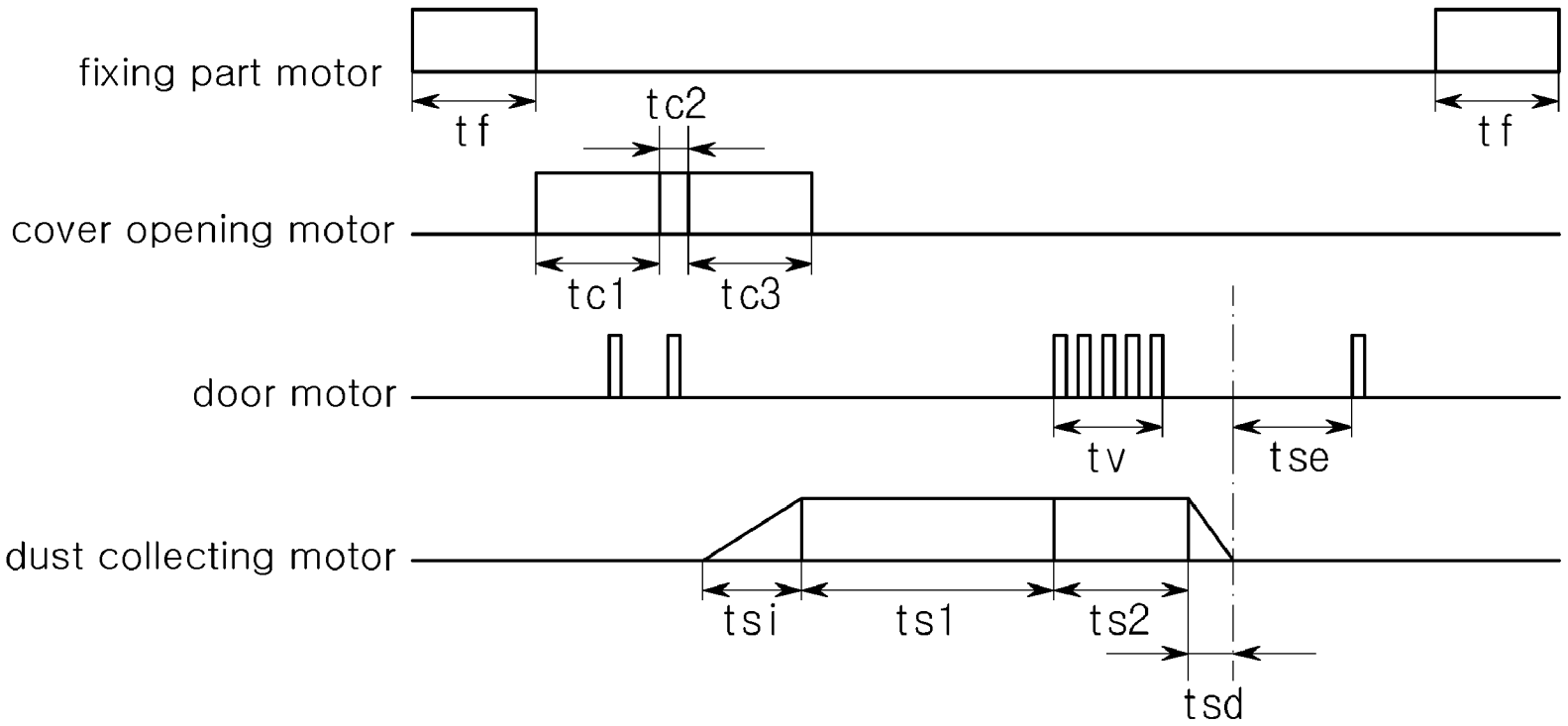

[FIG. 16]
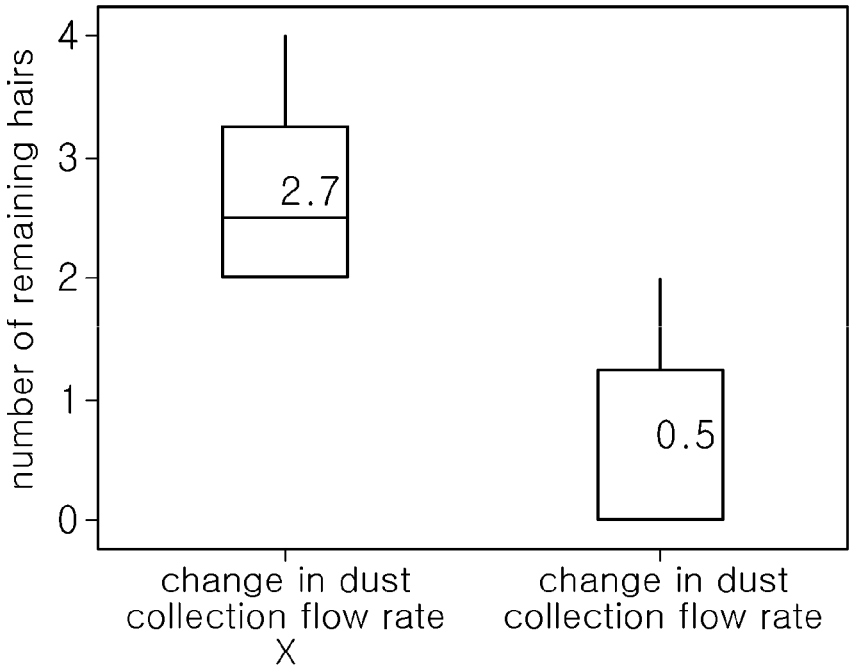

CLEANER STATION, CLEANER SYSTEM, AND CONTROL METHOD THEREFOR

CROSS-REFERENCE TO RELATED APPLICATIONS

This application is the National Phase of PCT/KR2022/000627 filed on Jan. 13, 2022, which claims priority under 35 U.S.C. § 119(a) to Patent Application No. 10-2021-0004353 filed in the Republic of Korea on Jan. 13, 2021, all of which are hereby expressly incorporated by reference into the present application.

BACKGROUND OF THE DISCLOSURE

Technical Field

The present disclosure relates to a cleaner station, a cleaner system, and a control method thereof, more particularly, to a cleaner station that sucks dust stored in a cleaner into a cleaner station based on the amount of dust stored in the cleaner, a cleaner system, and a control method thereof.

In general, a cleaner refers to an electrical appliance that draws in small garbage or dust by sucking air using electricity and fills a dust bin provided in a product with the garbage or dust. Such a cleaner is generally called a vacuum cleaner.

The cleaners can be classified into a manual cleaner, which is moved directly by a user to perform a cleaning operation, and an automatic cleaner, which performs a cleaning operation while autonomously traveling. Depending on the shape of the cleaner, the manual cleaners can be classified into a canister cleaner, an upright cleaner, a handheld cleaner, a stick cleaner, and the like.

Description of Related Art

Canister cleaners were widely used in the past as household cleaners. However, recently, there is an increasing tendency to use the handheld cleaner and the stick cleaner in which a dust bin and a cleaner main body are integrally provided to improve convenience of use.

In the case of the canister cleaner, a main body and a suction port are connected by a rubber hose or pipe, and in some instances, the canister cleaner can be used in a state in which a brush is fitted into the suction port.

The handheld cleaner (e.g., hand vacuum cleaner) has maximized portability and is light in weight. However, because the handheld cleaner has a short length, there can be a limitation to a cleaning region. Therefore, the handheld cleaner is used to clean a local place (e.g., small area), such as a desk, a sofa, or an interior of a vehicle.

A user can use the stick cleaner while standing and thus can perform a cleaning operation without bending his/her waist. Therefore, the stick cleaner is advantageous for the user to clean a wide region while moving in the region. The handheld cleaner can be used to clean a narrow space (e.g., small), whereas the stick cleaner can be used to clean a wide space and also used to clean a high place that the user's hand cannot reach (e.g., an area located out of reach of a user). Recently, modularized stick cleaners are provided, such that types of cleaners are actively changed and used to clean various places.

In addition, recently, a robot cleaner, which autonomously performs a cleaning operation without a user's manipulation, is used. The robot cleaner automatically cleans a zone to be cleaned by sucking foreign substances, such as dust from the floor while autonomously traveling in the zone to be cleaned.

However, because the handheld cleaner, the stick cleaner, or the robot cleaner in the related art has a dust bin with a small capacity for storing collected dust, they are not convenient to the user because the user needs to empty the dust bin frequently.

In addition, because the dust scatters during the process of emptying the dust bin of the cleaner, there is a problem in that the scattering dust has a harmful effect on the user's health.

In addition, if residual dust is not removed from the dust bin, there is a problem in that a suction force of the cleaner deteriorates.

In addition, if the residual dust is not removed from the dust bin, there is a problem in that the residual dust causes an offensive odor.

As a prior patent document, Korean Patent Publication No. 10-2020-0074001 discloses a cleaning apparatus including a vacuum cleaner and a docking station.

The prior patent document includes a vacuum cleaner including a dust collecting container in which foreign substances are collected, and a docking station configured to be connected to the dust collecting container to remove the foreign substances collected in the dust collecting container. The dust collecting container is configured to dock to the docking station, and include a suction device configured to suction the foreign substances and air in the dust collecting container docked to the docking station.

In addition, in the prior patent document, the docking station is configured to include a collector that collects foreign substances.

However, in the prior patent document, after stopping a suction operation, there is a problem in that the suction device (e.g., a suction fan) may not remove foreign substances attached to a peripheral portion of the dust collecting container during the suction process.

Accordingly, a user can need to handle the foreign substances exposed and attached to the peripheral portion of the dust collecting container, with his/her hand when the user uses the vacuum cleaner again after the process of suctioning the foreign substances (hereinafter, referred to as residual dust) is ended. Thus, the user can experience the inconvenience to directly remove the residual dust with a wet tissue or the like.

In addition, when the foreign substance is accumulated in the docking station, there is a problem in that the interior of the docking station is contaminated.

Meanwhile, in the prior patent document, a flow rate regulator can be included. However, the flow rate regulator is configured to strengthen the dust collecting power by additionally supplying air to the dust collecting container of the vacuum cleaner to increase the flow rate of the inside of the dust collecting container. That is, the prior patent document is configured to change the flow rate itself supplied to the dust bin.

However, although the flow rate regulator can strongly suction large dust (e.g., a large amount of dust) by increasing the flow rate of the inside of the dust collecting container, there is a limitation in removing small dust or hair adhering to the dust collecting container.

In addition, the volume of the station itself increases as a separate flow rate regulator is provided, and there is a limit to the increase in waste of time and energy in communicating the flow rate regulator and the dust collecting container.

SUMMARY OF THE DISCLOSURE

The present disclosure has been devised to solve the above described problems of the conventional cleaner station, cleaner system, and control method thereof, and an object of the present disclosure is to provide a cleaner station capable of sucking dirt remaining inside a dust bin and around a filter even after dust in the dust bin is collected.

In addition, an object of the present disclosure is to provide a cleaner station capable of providing user convenience by removing dust in a dust bin without a user's separate manipulation.

In addition, an object of the present disclosure is to provide a cleaner station capable of removing odors caused by residues by preventing residual dust from remaining in the dust bin.

In addition, an object of the present disclosure is to provide a cleaner station capable of preventing the scattering of dust when the dust bin is emptied (e.g., by a user).

In addition, an object of the present disclosure is to provide a cleaner station capable of removing dirt that can stick to an ultra-violet (UV) transmission window for sterilization.

In addition, an object of the present disclosure is to provide a cleaner station capable of preventing the impact and noise generated when a door of the vacuum cleaner is closed.

Technical Solution

In order to achieve the above objectives, a cleaner station according to the present disclosure is coupled to a cleaner comprising a dust bin and a discharge cover that selectively opens and closes the dust bin to remove a foreign substance inside the dust bin. The cleaner station can comprise a housing; a coupling part that is disposed on the housing and includes a coupling surface to which at least a part of the cleaner is coupled; a dust collection part that is accommodated inside the housing, is disposed on a lower side of the coupling part, and collects dust inside the dust bin of the cleaner; a dust collecting motor that is accommodated inside the housing, is disposed on a lower side of the dust collecting part, and generates a suction force to suck the dust inside the dust bin; and a door unit that includes a door hingedly coupled to the housing.

In this case, the discharge cover can selectively open and close a dust passage hole formed on the coupling surface by rotating in conjunction with a rotation of the door, and can rotate at least once during an operation of the dust collecting motor.

Accordingly, the door can rotate to change an open area of the dust passage hole during the operation of the dust collecting motor.

Meanwhile, the door can rotate to open the dust passage hole before the operation of the dust collecting motor starts.

In addition, the door motor can be operated in a state in which the dust collecting motor is operated for a predetermined dust collecting time.

The dust collecting motor can be operated at a predetermined dust collecting speed and can maintain the dust collecting speed when the door motor is operated.

The door can be rotated during the operation of the dust collecting motor, and a direction of the rotation is changed at least once.

Accordingly, in a state in which the dust collecting motor is operated at a predetermined dust collecting speed, a flow rate of air passing through the dust passage hole can be changed.

Meanwhile, the door can block the dust passage hole in a state in which the dust collecting motor is maintained.

In this case, the door can rotate within an angle range of 10 degrees or more and 90 degrees or less on a basis of a closed position blocking the dust passage hole.

In order to achieve the above objects, a method for controlling a cleaner station according to the present disclosure can comprise a dust bin fixing step of fixing a dust bin of a cleaner when the cleaner is coupled to a cleaner station; a door opening step of rotating a door of the cleaner station to open a dust passage hole when the dust bin is fixed; a dust collecting step of operating a dust collecting motor of the cleaner station in a state in which the door is opened, to collect dust in the dust bin; and an additional dust collecting step of maintaining a flow rate of air passing through the dust passage hole while changing a velocity of the air, after the dust collecting step.

In the additional dust collecting step, the door can be rotated to change an open area of the dust passage hole in a state in which the dust collecting motor is operated.

A flow rate of air passing through the dust passage hole in the additional dust collecting step can increase than the flow rate of the air passing through the dust passage hole in the dust collecting step.

A rotation speed of the dust collecting motor in the additional dust collecting step can maintain the rotation speed of the dust collecting motor in the dust collecting step.

In the additional dust collecting step, the door can be rotated to change an open area of the dust passage hole at least once in a state in which the dust collecting motor is operated, and then, the door can block the dust passage hole.

Meanwhile, the method for controlling a cleaner station can further comprise, after the operation of the dust collecting motor is ended, a door closing checking step of rotating the door to open at least a part of the dust passage hole and then closing the dust passage hole again.

In order to achieve the above objects, a cleaner system according to the present disclosure can comprise a cleaner including a main body including a suction part having a suction flow path through which air is able to flow and a dust separating part having at least one cyclone part, and a dust bin storing dust separated by the dust separating part; and a cleaner station including a dust collecting part collecting the dust inside the dust bin, a dust collecting motor generating a suction force for sucking the dust inside the dust bin into the dust collecting part, and a housing having the dust collecting part and the dust collecting motor therein along a longitudinal direction.

In this case, in a state in which the cleaner is coupled to the cleaner station, a longitudinal axis of the dust bin and a longitudinal axis of the cleaner station can intersect each other; when the cleaner is coupled to the cleaner station, a door of the cleaner station can be opened so that the dust bin can communicate with a flow path part of the cleaner station; the door can be rotated at least once in a state in which the dust collecting motor can be operated to change a flow rate of air discharged from the dust bin.

The dust bin can include a dust bin main body; and a discharge cover hingedly coupled to the dust bin main body to open and close an internal space of the dust bin main body. The discharge cover can be rotated to a predetermined cover opening position when the dust bin is coupled to the coupling part, and can be rotated to a predetermined flow rate change position in a state in which the dust collecting motor is operated.

In this case, the discharge cover can be provided to open and close one end of the dust bin main body in a longitudinal direction. An angle formed between one end of the dust bin main body in the longitudinal direction and the discharge cover at the flow rate change position can be smaller than the angle formed between the one end of the dust bin main body in the longitudinal direction and the discharge cover at the cover opening position.

An angle formed between one end of the dust bin main body in the longitudinal direction and the discharge cover at the flow rate change position can be 10 degrees or more and 35 degrees or less.

Advantageous Effects

As described above, according to the cleaner station, the cleaner system, and the control method thereof of the present disclosure, the dust inside the dust bin is collected, and then the door is rotated in a state in which the dust collecting motor is maintained, so that there is an effect of sucking the dirt remaining inside the dust bin and around the filter.

In addition, there is an effect of eliminating the inconvenience of the user having to empty the dustbin every time (e.g., after each use, or frequently).

In addition, in the case where the dust bin is emptied, there is an effect that dust in the dust bin is sucked into the station to prevent the dust from scattering (e.g., due to manual removal of the dust).

In addition, without a user's separate manipulation, it is possible to detect the coupling of the cleaner to open the dust passage hole and remove the dust in the dust bin according to the operation of the dust collecting motor, so that there is an effect of providing user convenience.

In addition, there is an effect of removing dirt attached to the UV transmission window by increasing the dust collection flow rate.

In addition, when opening and closing the door, by dividing the rotation angle of the door into several steps and rotating the door, there is an effect of preventing the impact and noise generated when the door is closed.

In addition, after collecting the dust inside the dust bin, the dust is additionally sucked through the bypass passage to suck in the dirt remaining in the dust bin and the cleaner station.

Further scope of applicability of the invention will become apparent from the detailed description given hereinafter. However, it should be understood that the detailed description and specific examples, while indicating embodiments of the invention, are given by way of illustration only, since various changes and modifications within the scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention.

FIG. 1 is a perspective view illustrating a cleaner system including a cleaner station and a cleaner according to an embodiment of the present disclosure.

FIG. 2 is a schematic view illustrating a configuration of a cleaner system according to an embodiment of the present disclosure.

FIG. 3 is a side view illustrating a cleaner of a cleaner system according to an embodiment of the present disclosure.

FIG. 4 is a cross-sectional view illustrating a dust separating part and cyclone filter of a first cleaner according to an embodiment of the present disclosure.

FIG. 5 is a perspective view illustrating a lower side of a dust bin of a first cleaner according to an embodiment of the present disclosure.

FIG. 6 is a view illustrating a coupling part in a cleaner station according to an embodiment of the present disclosure.

FIG. 7 is an exploded perspective view for explaining a fixing unit in a cleaner station according to an embodiment of the present invention.

FIG. 8 is an exploded perspective view for explaining a relationship between a first cleaner and a door unit in a cleaner station according to an embodiment of the present invention FIG. 9 is a view illustrating a relationship between a first cleaner and a cover opening unit in a cleaner station according to an embodiment of the present invention.

FIG. 10 is a block diagram for explaining a control configuration of a cleaner station according to an embodiment of the present disclosure.

FIG. 11 is a flowchart for explaining a method of controlling a cleaner station according to the present disclosure.

FIG. 12 is a view illustrating an operation of controlling each motor over time in a method of controlling a cleaner station according to a first embodiment of the present disclosure.

FIGS. 13*a* to 13*c* are views illustrating the degree of opening and closing of a door in an additional dust collecting step of the method for controlling a cleaner station according to a first embodiment of the present disclosure.

FIG. 14 is a view illustrating an operation of controlling each motor over time in a method of controlling a cleaner station according to a second embodiment of the present disclosure.

FIG. 15 is a view illustrating an operation of controlling each motor over time in a method of controlling a cleaner station according to a third embodiment of the present disclosure.

FIG. 16 is a graph illustrating an effect in a case of employing a cleaner station according to the present disclosure.

DETAILED DESCRIPTION OF THE EMBODIMENTS

The present invention will now be described with reference to the accompanying drawings, wherein the same reference numerals have been used to identify the same or similar elements throughout the several views.

The present disclosure can be variously modified and can have various embodiments, and particular embodiments illustrated in the drawings will be specifically described below. The description of the embodiments is not intended to limit the present disclosure to the particular embodiments, but it should be interpreted that the present disclosure is to cover all modifications, equivalents and alternatives falling within the spirit and technical scope of the present disclosure.

The terms used herein is used for the purpose of describing particular embodiments only and is not intended to limit the present disclosure. Singular expressions can include plural expressions unless clearly described as different meanings in the context.

Unless otherwise defined, all terms used herein, including technical or scientific terms, can have the same meaning as commonly understood by those skilled in the art to which the present disclosure pertains. The terms such as those defined in a commonly used dictionary can be interpreted as having meanings consistent with meanings in the context of related technologies and should not be interpreted as ideal or excessively formal meanings unless explicitly defined in the present application.

FIG. 1 is a perspective view illustrating a cleaner system configured to include a cleaner station, a first cleaner, and a second cleaner according to an embodiment of the present disclosure, and FIG. 2 is a schematic view illustrating a configuration of a cleaner system according to an embodiment of the present disclosure.

Referring to FIGS. 1 and 2, a cleaner system 10 according to an embodiment of the present specification can include a cleaner station 100 and cleaners 200 and 300. In this case, the cleaners 200 and 300 can include a first cleaner 200 and a second cleaner 300. Meanwhile, the present embodiment can be carried out without some of the above-mentioned components and does not exclude additional components.

The cleaner system 10 can include the cleaner station 100. The first cleaner 200 and the second cleaner 300 can be coupled to the cleaner station 100. The first cleaner 200 can be coupled to a lateral surface of the cleaner station 100. Specifically, a main body of the first cleaner 200 can be coupled to the lateral surface of the cleaner station 100. The second cleaner 300 can be coupled to a lower portion of the cleaner station 100. The cleaner station 100 can remove dust from a dust bin 220 of the first cleaner 200. The cleaner station 100 can remove dust from a dust bin of the second cleaner 300.

Meanwhile, FIG. 3 is a view for explaining the first cleaner of the cleaner system according to the embodiment of the present disclosure, FIG. 4 is a view for explaining a dust separating part and cyclone filter of the first cleaner according to an embodiment of the present disclosure, and FIG. 5 is a view for explaining a lower side of the dust bin of the first cleaner according to an embodiment of the present disclosure.

First, a structure of the first cleaner 200 will be described below with reference to FIGS. 1 to 5.

The first cleaner 200 can include a cleaner configured to be manually operated by a user. For example, the first cleaner 200 can be a handheld cleaner or a stick cleaner.

The first cleaner 200 can be mounted on the cleaner station 100. The first cleaner 200 can be supported by the cleaner station 100. The first cleaner 200 can be coupled to the cleaner station 100.

Meanwhile, in the embodiment of the present disclosure, directions can be defined on the basis of a state in which a bottom surface (e.g., lower surface) of the dust bin 220 and a bottom surface (e.g., lower surface) of a battery housing 230 are placed on a ground surface.

In this case, a forward direction can be a direction in which a suction part 212 is disposed based on a suction motor 214, and a rear direction can be a direction in which a handle 216 is disposed. Further, on the basis of a state in which the suction part 212 is viewed from the suction motor 214, a right direction can refer to a direction in which a component is disposed at the right, and a left direction can refer to a direction in which a component is disposed at the left. In addition, in the embodiment of the present disclosure, upper and lower sides can be defined in a direction perpendicular to the ground surface on the basis of the state in which the bottom surface (e.g., lower surface) of the dust bin 220 and the bottom surface (e.g., lower surface) of the battery housing 230 are placed on the ground surface.

The first cleaner 200 can include a main body 210. The main body 210 can include a main body housing 211, a suction part 212, a dust separating part 213, a suction motor 214, an air discharge cover 215, a handle 216, and an operating part 218.

The main body housing 211 can define an external appearance of the first cleaner 200. The main body housing 211 can provide a space that can accommodate therein the suction motor 214 and a filter. The main body housing 211 can be formed in a shape similar to a cylindrical shape.

The suction part 212 can protrude outward from the main body housing 211. For example, the suction part 212 can be formed in a cylindrical shape with an opened inside. The suction part 212 can be coupled to an extension tube 250. The suction part 212 can provide a flow path (hereinafter, referred to as a 'suction flow path') through which air containing dust can flow.

Meanwhile, in the present embodiment, an imaginary line can be defined to penetrate the inside of the suction part 212 having a cylindrical shape. That is, an imaginary suction flow path through line a2 can be formed to penetrate the suction flow path in a longitudinal direction.

The dust separating part 213 can communicate with the suction part 212. The dust separating part 213 can separate dust introduced into the dust separating part 213 through the suction part 212. A space in the dust separating part 213 can communicate with a space in the dust bin 220.

For example, the dust separating part 213 can have two or more cyclone parts capable of separating dust using a cyclone flow. Further, the space in the dust separating part 213 can communicate with the suction flow path. Therefore, the air and the dust, which are introduced through the suction part 212, spirally flow along an inner circumferential surface of the dust separating part 213. Therefore, the cyclone flow can be generated in the internal space of the dust separating part 213.

The dust separating part 213 is in communication with the suction part 212 and uses the principle of a dust collector using a centrifugal force to separate dust sucked into the main body 210 through the suction part 212. That is, the dust separating part 213 uses centrifugal force to separate dust sucked into the main body 210 through the suction part 212.

For example, the dust separating part 213 can include at least one cyclone capable of separating dust by cyclone flow. The cyclone can communicate with the suction part 212 and can be a vane that causes the air to spin in the dust separating part 213 to generate the centrifugal force. The air and dust sucked through the suction part 212 spirally flows along the inner circumferential surface of the cyclone.

The dust separating part 213 can further include a secondary cyclone that re-separates dust from the air discharged from the cyclone. In this case, the secondary cyclone can be located inside the cyclone so that the size of the dust separating part is minimized. The secondary cyclone can include a plurality of cyclone bodies arranged in parallel. The air discharged from the cyclone can pass through divided into a plurality of cyclone bodies.

In this case, the axis of the cyclone flow of the secondary cyclone can also extend in the vertical direction, and the axis of the cyclone flow of the cyclone and the axis of the cyclone flow of the secondary cyclone can form a coaxial axis in the vertical direction. This can be collectively referred to as an axis of the cyclone flow of the dust separating part 213. Meanwhile, in this embodiment, an imaginary cyclone line a4 can be formed with respect to the axis of the cyclone flow.

The dust separating part 213 can further include a cyclone filter 219 disposed to surround (e.g., surrounding) the secondary cyclone part. The cyclone filter 219 can be formed in a cylindrical shape, for example, and guides the air separated from dust in the cyclone to the secondary cyclone. The cyclone filter 219 can filter dust while air passes therethrough.

To this end, the cyclone filter 219 can include a mesh portion having a plurality of holes. The mesh portion is not limited, but can be formed of a metal material.

The suction motor 214 can generate a suction force for sucking air. The suction motor 214 can be accommodated in the main body housing 211. The suction motor 214 can generate the suction force by means of a rotation (e.g., by rotation of the suction motor 214). For example, the suction motor 214 can be formed in a shape similar to a cylindrical shape.

Meanwhile, in the present embodiment, an imaginary suction motor axis a1 can be formed by extending a rotation axis of the suction motor 214.

The air discharge cover 215 can be disposed at one side in an axial direction of the main body housing 211. A filter for filtering air can be accommodated in the air discharge cover 215. For example, an HEPA filter can be accommodated in the air discharge cover 215.

The air discharge cover 215 can have an air discharge port 215*a* for discharging the air introduced by the suction force of the suction motor 214.

A flow guide can be disposed on the air discharge cover 215. The flow guide can guide a flow of the air to be discharged through the air discharge port 215*a*.

The handle 216 can be grasped (e.g., held) by the user. The handle 216 can be disposed at a rear side of the suction motor 214. For example, the handle 216 can be formed in a shape similar to a cylindrical shape. Alternatively, the handle 216 can be formed in a curved cylindrical shape. The handle 216 can be disposed at a predetermined angle with respect to the main body housing 211, the suction motor 214, or the dust separating part 213.

The handle 216 can include a grip portion 216*a* formed in a column shape so that the user can grasp the grip portion 216*a*, a first extension portion 216*b* connected to one end in the longitudinal direction (axial direction) of the grip portion 216*a* and extending toward the suction motor 214, and a second extension portion 216*c* connected to the other end in the longitudinal direction (axial direction) of the grip portion 216*a* and extending toward the dust bin 220.

Meanwhile, in the present embodiment, an imaginary grip portion through line a3 can be formed to extend in the longitudinal direction of the grip portion 216*a* (e.g., the axial direction of the column) and penetrate the grip portion 216*a*.

For example, the grip portion 216*a* through line a3 can be an imaginary line formed in the handle 216 having a cylindrical shape, that is, an imaginary line formed in parallel with at least a part of an outer surface (outer circumferential surface) of the grip portion 216*a*.

An upper surface of the handle 216 can define an external appearance of a part of an upper surface of the cleaner 200. Therefore, it is possible to prevent a component of the cleaner 200 from coming into contact with the user's arm when the user grasps the handle 216.

The first extension portion 216*b* can extend from the grip portion 216*a* toward the main body housing 211 or the suction motor 214. At least a part of the first extension portion 216*b* can extend in a horizontal direction.

The second extension portion 216*c* can extend from the grip portion 216*a* toward the dust bin 220. At least a part of the second extension portion 216*c* can extend in the horizontal direction.

The operating part 218 can be disposed on the handle 216. The operating part 218 can be disposed on an inclined surface formed in an upper region of the handle 216. The user can input an instruction to operate or stop the first cleaner 200 through the operating part 218. That is, the operating part 218 can include inputs for various actions of the first cleaner 200, including to start (e.g., operate), to stop, or the like, and these inputs can be in the form of physical buttons or a touchscreen icons, which are selectable by a user.

The first cleaner 200 can include the dust bin 220. The dust bin 220 can communicate with the dust separating part 213. The dust bin 220 can store the dust separated by the dust separating part 213.

The dust bin 220 can include a dust bin main body 221, a discharge cover 222, a dust bin compression lever 223, and a compression member.

The dust bin main body 221 can provide a space capable of storing the dust separated from the dust separating part 213. For example, the dust bin main body 221 can be formed in a shape similar to a cylindrical shape, however, the dust bin main body 221 can have any shape.

Meanwhile, in the present embodiment, an imaginary dust bin through line a5 can be formed to penetrate the inside (e.g., an internal space) of the dust bin main body 221 and extend in the longitudinal direction of the dust bin main body 221 (e.g., the axial direction of the cylindrical dust bin main body 221).

A part of a lower side (bottom side) of the dust bin main body 221 can be opened. In addition, a lower extension portion 221*a* can be formed at the lower side (e.g., bottom side) of the dust bin main body 221. The lower extension portion 221*a* can be formed to block a part of the lower side of the dust bin main body 221.

The dust bin 220 can include a discharge cover 222. The discharge cover 222 can be disposed at a lower side of the dust bin 220.

The discharge cover 222 can be provided to open and close one end of the dust bin main body 221 in the longitudinal direction. Particularly, the discharge cover 222 can selectively open or close the lower side of the dust bin 220 which is opened downward.

The discharge cover 222 can include a cover main body 222*a* and a hinge part 222*b*. The cover main body 222*a* can be formed to block a part of the lower side of the dust bin main body 221. The cover main body 222*a* can be rotated (e.g., upward and downward) about the hinge part 222*b*. The hinge part 222*b* can be disposed adjacent to the battery housing 230. For example, the hinge part 222*b* can include a torsion spring 222*d*. Therefore, when the discharge cover 222 is separated from the dust bin main body 221, the cover main body 222*a* can be supported while being rotated by a predetermined angle or more about the hinge part 222*b* (e.g., toward or away from an axis in the dust bin main body 221. The discharge cover 222 is supported by the elastic force of the torsion spring 222*d* during rotation about the hinge part 222*b*, and the hinge part 222*b*.

The discharge cover 222 can be coupled to the dust bin 220 by a hook engagement. Meanwhile, the discharge cover 222 can be separated from the dust bin 220 by means of the coupling lever 222*c*. The coupling lever 222*c* can be disposed at a front side of the dust bin. Specifically, the coupling lever 222*c* can be disposed on an outer surface at the front side of the dust bin 220. When external force is applied to the coupling lever 222*c*, the coupling lever 222*c* can elastically deform a hook extending from the cover main body 222*a* in order to release the hook engagement between the cover main body 222*a* and the dust bin main body 221.

When the discharge cover 222 is closed, the lower side of the dust bin 220 can be blocked (e.g., sealed) by the discharge cover 222 and the lower extension portion 221*a*.

In a state in which the first cleaner 200 is coupled to the cleaner station 100, the lower portion of the dust bin 220 can be disposed on a dust passage hole 121*a* to be described later (see FIG. 6). When the discharge cover 222 is opened in this state, the discharge cover 222 can rotate on the dust passage hole 121*a* (see FIG. 13*b*). Accordingly, the dust passage hole 121*a* can be selectively opened and closed by rotation of the discharge cover 222. Also, the connection between the dust passage hole 121*a* and the internal space of the dust bin 220 can be selectively opened and closed by the discharge cover 222.

The dust bin 220 can include the dust bin compression lever 223 (see FIG. 8). The dust bin compression lever 223 can be disposed outside the dust bin 220 or the dust separating part 213. The dust bin compression lever 223 can be disposed outside the dust bin 220 or the dust separating part 213 so as to be movable upward and downward. The dust bin compression lever 223 can be connected to the compression member. When the dust bin compression lever 223 is moved downward by external force, the compression member can also be moved downward. Therefore, it is possible to provide convenience for the user. The compression member and the dust bin compression lever 223 can return back to original positions by an elastic member. Specifically, when the external force applied to the dust bin compression lever 223 is eliminated, the elastic member can move the dust bin compression lever 223 and the compression member upward.

The compression member can be disposed in the dust bin main body 221. The compression member can move in the internal space of the dust bin main body 221. Specifically, the compression member can move upward and downward in the dust bin main body 221. Therefore, the compression member can compress the dust in the dust bin main body 221 downward. In addition, when the discharge cover 222 is separated from the dust bin main body 221 and thus the lower side of the dust bin 220 is opened, the compression member can move from an upper side of the dust bin 220 to the lower side of the of the dust bin 220, thereby removing foreign substances, such as residual dust in the dust bin 220. Therefore, it is possible to improve the suction force of the cleaner by preventing the residual dust from remaining in the dust bin 220. Further, it is possible to remove an offensive odor caused by the residual dust by preventing the residual dust from remaining in the dust bin 220.

The first cleaner 200 can include a battery housing 230. A battery 240 can be accommodated in the battery housing 230. The battery housing 230 can be disposed at a lower side of the handle 216. For example, the battery housing 230 can have a hexahedral shape opened at a lower side thereof, however, the battery housing 230 is not limited to a hexahedral shape, and can be any shape. A rear surface of the battery housing 230 can be connected to the handle 216.

The battery housing 230 can include an accommodation portion opened at a lower side thereof. The battery 230 can be attached or detached through the accommodation portion of the battery housing 220.

The first cleaner 200 can include the battery 240.

For example, the battery 240 can be separably coupled (e.g., detachably coupled) to the first cleaner 200. The battery 240 can be separably coupled (e.g., detachably coupled) to the battery housing 230. For example, the battery 240 can be inserted into the battery housing 230 from the lower side of the battery housing 230. The above-mentioned configuration can improve portability of the first cleaner 200.

Otherwise, the battery 240 can be integrally provided in the battery housing 230. In this case, a lower surface of the battery 240 is not exposed to the outside.

The battery 240 can supply power to the suction motor 214 of the first cleaner 200. The battery 240 can be disposed on a lower portion of the handle 216. The battery 240 can be disposed at a rear side of the dust bin 220. That is, the suction motor 214 and the battery 240 can be disposed so as not to overlap each other in the upward/downward direction (e.g., vertical direction) and can be disposed at different disposition heights. On the basis of the handle 216, the suction motor 214, which is relatively heavy in weight, is disposed at a front side of the handle 216, and the battery 240, which is relatively heavy in weight, is disposed at the lower side of the handle 216, such that an overall weight of the first cleaner 200 can be uniformly distributed. Therefore, it is possible to prevent stress from being applied to the user's wrist when the user grasps the handle 216 and performs a cleaning operation.

In a case in which the battery 240 is coupled to the battery housing 230 in accordance with the embodiment, the lower surface of the battery 240 can be exposed to the outside. Because the battery 240 can be placed on the floor when the first cleaner 200 is placed on the floor (e.g., the battery 240 can form a bottom surface of the first cleaner 200), the battery 240 can be immediately separated from the battery housing 230. In addition, because the lower surface of the battery 240 is exposed to the outside and thus in direct contact with air outside the battery 240, performance of cooling the battery 240 can be improved (e.g., thermal exchanger of the battery 240 with outside air improves cooling of the battery 240).

Meanwhile, in a case in which the battery 240 is fixed integrally to the battery housing 230, the number of structures for attaching or detaching the battery 240 and the battery housing 230 can be reduced, and as a result, it is possible to reduce an overall size of the first cleaner 200 and a weight of the first cleaner 200.

The first cleaner 200 can include an extension tube 250. The extension tube 250 can communicate (e.g., fluidly communicate) with a cleaning module 260 and the extension tube 250 can be directly attached to the cleaning module 260. The extension tube 250 can communicate (e.g., fluidly communicate) with the main body 210 and the extension tube 250 can be directly attached to the main body 210. The extension tube 250 can communicate (e.g., fluidly communicate) with the suction part 214 of the main body 210. The extension tube 250 can be formed in a long cylindrical shape, but is not limited thereto and thus the extension tube 250 can have any shape.

The main body 210 can be connected to the extension tube 250. The main body 210 can be connected to the cleaning module 260 through the extension tube 250. The main body 210 can generate the suction force by means of the suction motor 214 and provide the suction force to the cleaning module 260 through the extension tube 250. The outside dust can be introduced into the main body 210 through the cleaning module 260 and the extension tube 250.

The first cleaner 200 can include the cleaning module 260. The cleaning module 260 can communicate (e.g., fluidly communicate) with the extension tube 260. Therefore, the outside air can be introduced into the main body 210 of the first cleaner 200 via the cleaning module 260 and the extension tube 250 by the suction force in the main body 210 of the first cleaner 200.

The dust in the dust bin 220 of the first cleaner 200 can be captured by a dust collecting part 170 of the cleaner station 100 by gravity and a suction force of a dust collecting motor 191. Therefore, it is possible to remove the dust in the dust bin without the user's separate manipulation, thereby providing convenience for the user. In addition, it is possible to eliminate the inconvenience caused because the user needs to empty the dust bin all the time. In addition, it is possible to prevent the dust from scattering when emptying the dust bin.

The first cleaner 200 can be coupled to a lateral surface of a housing 110. Specifically, the main body 210 of the first cleaner 200 can be mounted on a coupling part 120. More specifically, the dust bin 220 and battery housing 230 of the first cleaner 200 can be coupled to a coupling surface 121, an outer circumferential surface of the dust bin main body 221 can be coupled to a dust bin guide surface 122, and the suction part 212 can be coupled to a suction part guide surface 126 of the coupling part 120. In this case, a central axis of the dust bin 220 can be disposed in a direction parallel to the ground surface, and the extension tube 250 can be disposed in a direction perpendicular to the ground surface (see FIG. 2).

The cleaner system 10 can include the second cleaner 300. The second cleaner 300 can be a robot cleaner. The second cleaner 300 can automatically clean a zone to be cleaned by sucking foreign substances, such as dust, from the floor while autonomously traveling in the zone to be cleaned. The second cleaner 300, that is, the robot cleaner, can include a distance sensor configured to detect a distance of the second cleaner 300 from an obstacle, such as furniture, office supplies, or walls installed in the zone to be cleaned, and left and right wheels for moving the robot cleaner. The second cleaner 300 can be coupled to the cleaner station 100. The dust in the second cleaner 300 can be captured into the dust collecting part 170 through a second flow path.

The cleaner station 100 according to the present disclosure will be described below with reference to FIGS. 1 and 2.

The first cleaner 200 and the second cleaner 300 can be disposed on the cleaner station 100. The first cleaner 200 can be coupled to the lateral surface of the cleaner station 100. Specifically, the main body of the first cleaner 200 can be coupled to the lateral surface of the cleaner station 100. The second cleaner 200 can be coupled to the lower portion of the cleaner station 100. The cleaner station 100 can remove the dust from the dust bin 220 of the first cleaner 200. The cleaner station 100 can remove the dust from the dust bin of the second cleaner 300.

The cleaner station 100 can include the housing 110. The housing 110 can define an external appearance of the cleaner station 100. Specifically, the housing 110 can be formed in the form of a column including one or more outer wall surfaces, but is not limited thereto and can be any shape. For example, the housing 110 can be formed in a shape similar to a quadrangular column.

The housing 110 can have a space capable of accommodating the dust collecting part 170 configured to store dust therein, and a dust suction module 190 configured to generate a flow force for collecting the dust from the dust collecting part 130.

The housing 110 can include a bottom surface 111, an outer wall surface 112, and an upper surface 113.

The bottom surface 111 can support a lower side in a gravitational direction of the dust suction module 190. That is, the bottom surface 111 can support a lower side of the dust collecting motor 191 of the dust suction module 190.

In this case, the bottom surface 111 can be disposed toward the ground surface. The bottom surface 111 can also be disposed in parallel with the ground surface or disposed to be inclined at a predetermined angle with respect to the ground surface. The above-mentioned configuration can be advantageous in stably supporting the dust collecting motor 191 and maintaining the balance of an overall weight even in a case in which the first cleaner 200 is coupled.

Meanwhile, according to the embodiment, the bottom surface 111 can further include ground surface support portions 111*a* in order to prevent the cleaner station 100 from falling down and increase an area being in contact with the ground surface to maintain the balance. For example, the ground surface support portion can have a plate shape extending from (e.g., laterally extending from) the bottom surface 111, and one or more frames can protrude and extend from the bottom surface 111 in a direction of the ground surface.

The outer wall surface 112 can be a surface formed in the gravitational direction or surface connected to the bottom surface 111. For example, the outer wall surface 112 can be a surface vertically connected to the bottom surface 111. As another embodiment, the outer wall surface 112 can be disposed to be inclined at a predetermined angle with respect to the bottom surface 111.

The outer wall surface 112 can include at least one surface. For example, the outer wall surface 112 can include a first outer wall surface 112*a*, a second outer wall surface 112*b*, a third outer wall surface 112*c*, and a fourth outer wall surface 112*d*.

In this case, in the present embodiment, the first outer wall surface 112*a* can be disposed on the front surface of the cleaner station 100. In this case, the front surface can be a surface on which the first cleaner 200 is exposed in a state in which the first cleaner 200 is coupled to the cleaner station 100. Therefore, the first outer wall surface 112*a* can define an external appearance of the front surface of the cleaner station 100.

Meanwhile, the directions are defined as follows to understand the present embodiment. In the present embodiment, the directions can be defined in the state in which the first cleaner 200 is mounted on the cleaner station 100.

In the state in which the first cleaner 200 is mounted on the cleaner station 100, a direction in which the first cleaner 200 is exposed to the outside of the cleaner station 100 can be referred to as a forward direction.

In another point of view, in the state in which the first cleaner 200 is mounted on the cleaner station 100, a direction in which the suction motor 214 of the first cleaner 200 is disposed can be referred to as the forward direction. Further, a direction opposite to the direction in which the suction motor 214 is disposed on the cleaner station 100 can be referred to as a rearward direction.

In still another point of view, a direction in which an intersection point at which the grip portion through line a3 and the suction motor axis a1 intersect is disposed can be referred to as the forward direction on the basis of the cleaner station 100. The forward direction can also be along the suction motor axis a1 and toward the air discharge cover 215 (i.e., from a surface of the dust bin 220 opposite to the air discharge cover, in a direction toward the air discharge cover, and along the suction motor axis a1). Alternatively, a direction in which an intersection point P2 at which the grip portion through line a3 and the suction flow path through line a2 intersect is disposed can be referred to as the forward direction. Alternatively, a direction in which an intersection point P1 at which the suction motor axis a1 and the suction flow path through line a2 intersect is disposed can be referred to as the forward direction. Further, a direction opposite to the direction in which the intersection point is disposed can be referred to as the rearward direction on the basis of the cleaner station 100.

Further, on the basis of the internal space of the housing 110, a surface facing the front surface can be referred to as a rear surface of the cleaner station 100. Therefore, the rear surface can be a direction in which the second outer wall surface 112*b* is formed.

Further, on the basis of the internal space of the housing 110, a left surface when viewing the front surface can be referred to as a left surface, and a right surface when viewing the front surface can be referred to as a right surface. Therefore, the left surface can be a direction in which the third outer wall surface 112*c* is formed, and the right surface can be a direction in which the fourth outer wall surface 112*d* is formed.

The first outer wall surface 112*a* can be formed in the form of a flat surface, or the first outer wall surface 112*a* can be formed in the form of a curved surface as a whole or formed to partially include a curved surface.

The first outer wall surface 112*a* can have an external appearance corresponding to the shape of the first cleaner 200. In detail, the coupling part 120 can be disposed in the first outer wall surface 112*a*. With this configuration, the first cleaner 200 can be coupled to the cleaner station 100 and supported by the cleaner station 100. The specific configuration of the coupling part 120 will be described below.

Meanwhile, a structure for mounting various types of cleaning modules 260 used for the first cleaner 200 can be additionally provided on the first outer wall surface 112*a*.

In addition, a structure to which the second cleaner 300 can be coupled can be additionally provided on the first outer wall surface 112*a*. Therefore, the structure corresponding to the shape of the second cleaner 300 can be additionally provided on the first outer wall surface 112*a*.

Further, a cleaner bottom plate to which the lower surface of the second cleaner 300 can be coupled can be additionally coupled to the first outer wall surface 112*a*. Meanwhile, as another embodiment, the cleaner bottom plate can be shaped to be connected to the bottom surface 111.

In the present embodiment, the second outer wall surface 112*b* can be a surface facing the first outer wall surface 112*a*. That is, the second outer wall surface 112*b* can be disposed on the rear surface of the cleaner station 100. In this case, the rear surface can be a surface facing the surface to which the first cleaner 200 or the second cleaner 300 is coupled. Therefore, the second outer wall surface 112*b* can define an external appearance of the rear surface of the cleaner station 100.

For example, the second outer wall surface 112*b* can be formed in the form of a flat surface. With this configuration, the cleaner station 100 can be in close contact with a wall in a room, and the cleaner station 100 can be stably supported.

As another example, the structure for mounting various types of cleaning modules 260 used for the first cleaner 200 can be additionally provided on the second outer wall surface 112*b*.

In addition, the structure to which the second cleaner 300 can be coupled can be additionally provided on the second outer wall surface 112*b*. Therefore, the structure corresponding to the shape of the second cleaner 300 can be additionally provided on the second outer wall surface 112*b*.

Further, a cleaner bottom plate to which the lower surface of the second cleaner 300 can be coupled can be additionally coupled to the second outer wall surface 112*b*. Meanwhile, as another embodiment, the cleaner bottom plate can be shaped to be connected to the bottom surface 111. With this configuration, when the second cleaner 300 is coupled to the cleaner bottom plate, an overall center of gravity of the cleaner station 100 can be lowered, such that the cleaner station 100 can be stably supported.

In the present embodiment, the third outer wall surface 112*c* and the fourth outer wall surface 112*d* can be surfaces that connect the first outer wall surface 112*a* and the second outer wall surface 112*b*. In this case, the third outer wall surface 112*c* can be disposed on the left surface of the station 100, and the fourth outer wall surface 112*d* can be disposed on the right surface of the cleaner station 100. Otherwise, the third outer wall surface 112*c* can be disposed on the right surface of the cleaner station 100, and the fourth outer wall surface 112*d* can be disposed on the left surface of the cleaner station 100.

The third outer wall surface 112*c* or the fourth outer wall surface 112*d* can be formed in the form of a flat surface, or can be formed in the form of a curved surface as a whole or formed to partially include a curved surface.

Meanwhile, the structure for mounting various types of cleaning modules 260 used for the first cleaner 200 can be additionally provided on the third outer wall surface 112*c* or the fourth outer wall surface 112*d*.

In addition, the structure to which the second cleaner 300 can be coupled can be additionally provided on the third outer wall surface 112*c* or the fourth outer wall surface 112*d*. Therefore, the structure corresponding to the shape of the second cleaner 300 can be additionally provided on the third outer wall surface 112*c* or the fourth outer wall surface 112*d*.

Further, a cleaner bottom plate to which the lower surface of the second cleaner 300 can be coupled can be additionally provided on the third outer wall surface 112*c* or the fourth outer wall surface 112*d*. Meanwhile, as another embodiment, the cleaner bottom plate can be shaped to be connected to the bottom surface 111.

The upper surface 113 can form the upper external appearance of the cleaner station. That is, the upper surface 113 can refer to a surface disposed on the uppermost side in the gravitational direction in the cleaner station and exposed to the outside.

For reference, in the present embodiment, upper and lower sides can respectively mean upper and lower sides along the gravitational direction (a direction perpendicular to the ground surface) in a state where the cleaner station 100 is installed on the ground.

In this case, the upper surface 113 can be disposed parallel to the ground surface or inclined at a predetermined angle with the ground surface.

The display part 410 can be disposed on the upper surface 113. For example, the display part 410 can display the state of the cleaner station 100, the state of the first cleaner 200, and the state of the second cleaner 300, as well as information on a cleaning progress status, a cleaning area map, or the like.

Meanwhile, the upper surface 113 can be provided to be detachable from the outer wall surface 112 according to the embodiment. In this case, when the upper surface 113 is separated, the battery separated from the cleaners 200 and 300 can be accommodated in the internal space surrounded by the outer wall surface 112, and a terminal capable of charging the separated battery can be provided in the internal space surrounded by the outer wall surface 112.

FIG. 6 is a view for explaining a coupling part in a cleaner station according to an embodiment of the present disclosure, FIG. 7 is an exploded perspective view for explaining a fixing unit in a cleaner station according to an embodiment of the present invention, FIG. 8 is an exploded perspective view for explaining a relationship between a first cleaner and a door unit in a cleaner station according to an embodiment of the present invention, and FIG. 9 is a view for explaining a relationship between a first cleaner and a cover opening unit in a cleaner station according to an embodiment of the present invention.

The coupling part 120 of the cleaner station 100 according to the present disclosure will be described below with reference to FIGS. 2 and 6.

The cleaner station 100 can include the coupling part 120 to which the first cleaner 200 is coupled. Specifically, the coupling part 120 can be disposed in the first outer wall surface 112*a*, and the main body 210, dust bin 220, and battery housing 230 of the first cleaner 200 can be coupled to the coupling part 120.

The coupling part 120 can include a coupling surface 121. The coupling surface 121 can be disposed on the lateral surface of the housing 110. For example, the coupling surface 121 can be a surface formed in the form of a groove which is concave toward the inside of the cleaner station 100 from the first outer wall surface 112*a*. That is, the coupling surface 121 can be a surface formed to have a step with respect to the first outer wall surface 112*a*.

The first cleaner 200 can be coupled to the coupling surface 121. For example, the coupling surface 121 can be in contact with the lower surfaces of the dust bin 220 and battery housing 230 of the first cleaner 200. In this case, the lower surface can be a surface directed toward the ground surface when the user uses the first cleaner 200 or places the first cleaner 200 on the ground surface.

For example, an angle of the coupling surface 121 with respect to the ground surface can be a right angle (e.g., 90° or perpendicular). Therefore, it is possible to minimize a space of the cleaner station 100 when the first cleaner 200 is coupled to the coupling surface 121.

As another example, the coupling surface 121 can be disposed to be inclined at a predetermined angle with respect to the ground surface. Therefore, the cleaner station 100 can be stably supported when the first cleaner 200 is coupled to the coupling surface 121.

The coupling surface 121 can have a dust passage hole 121*a* through which air outside the housing 110 can be introduced into the housing 110. The dust passage hole 121*a* can be formed in the form of a hole corresponding to the shape of the dust bin 220 so that the dust in the dust bin 220 can be introduced into the dust collecting part 170. The dust passage hole 121*a* can be formed to correspond to the shape of the discharge cover 222 of the dust bin 220. The dust passage hole 121*a* can be formed to communicate (e.g., fluidly communicate) with a first cleaner flow path part 181 to be described below. Specifically, the dust passage hole 121*a* can be selectively opened and closed by the door 141, and when the door 141 is opened, the dust passage hole 121*a* can communicate (e.g., fluidly communicate) with the flow path part 181. Also, in a state in which the first cleaner 200 is coupled to the cleaner station 100, the dust passage hole 121*a* can be formed to communicate (e.g., fluidly communicate) with an internal space of the dust container 220 of the first cleaner 200. Specifically, the dust passage hole 121*a* can be selectively opened and closed by the discharge cover 222 of the dust bin 220, and when the discharge cover 222 is opened from the dust bin main body 221, the dust passage hole 121*a* can communicate (e.g., fluidly communicate) with the internal space of the dust bin 220 (see FIG. 13*b*).

The coupling part 120 can include the dust bin guide surface 122. The dust bin guide surface 122 can be disposed on the first outer wall surface 112*a*. The dust bin guide surface 122 can be connected to the first outer wall surface 112*a*. In addition, the dust bin guide surface 122 can be connected to the coupling surface 121.

The dust bin guide surface 122 can be formed in a shape corresponding to the outer surface of the dust bin 220. A front outer surface of the dust bin 220 can be coupled to the dust bin guide surface 122. Therefore, it is possible to provide convenience when coupling the first cleaner 200 to the coupling surface 121.

Meanwhile, a protrusion movement hole 122*a* can be formed in the dust bin guide surface 122, and a push protrusion 151 to be described later can linearly move along the projection movement hole 122*a* (see FIG. 9). In addition, a gear box 155 accommodating a gear of the cover opening unit 150 to be described later can be provided on the lower side of the dust bin guide surface 122 in the gravitational direction. In this case, a guide space 122*b* in which the push protrusion 151 can move can be formed between the lower surface of the dust bin guide surface 122 and the upper surface of the gear box 155. Also, the guide space 122*b* can communicate (e.g., fluidly communicate) with a first flow path 181*a* of the first cleaner flow path part 181 through a bypass hole 122*c*. That is, the protrusion movement hole 122*a*, the guide space 122*b*, the bypass hole 122*c*, and the first flow path 181*a* can form one bypass flow path (see FIG. 9). With this configuration, when the dust collecting motor 191 is operated in a state where the dust bin 220 is coupled to the coupling part 120, there is an advantage in that dust or the like remaining on the dust bin 220 and the dust bin guide surface 122 can be sucked through the bypass passage.

The coupling part 120 can include guide protrusions 123. The guide protrusions 123 can be disposed on the coupling surface 121. The guide protrusions 123 can protrude upward from the coupling surface 121. Two guide protrusions 123 can be disposed to be spaced apart from each other. A distance between the two guide protrusions 123, which are spaced apart from each other, can correspond to a width of the battery housing 230 of the first cleaner 200. Therefore, it is possible to provide convenience when coupling the first cleaner 200 to the coupling surface 121.

The coupling part 120 can include sidewalls 124. The sidewalls 124 can be wall surfaces disposed on two lateral surfaces of the coupling surface 121 and can be perpendicularly connected to the coupling surface 121. The sidewalls 124 can be connected to the first outer wall surface 112*a*. In addition, the sidewalls 124 can define surfaces connected to the dust bin guide surface 122. Therefore, the first cleaner 200 can be stably accommodated.

The coupling part 120 can include a coupling sensor 125. The coupling sensor 125 can detect whether the first cleaner 200 is coupled to the coupling part 120.

The coupling sensor 125 can include a contact sensor. For example, the coupling sensor 125 can include a microswitch. In this case, the coupling sensor 125 can be disposed on the guide protrusion 123 (e.g., one of the guide protrusions 123). Therefore, when the battery housing 230 or battery 240 of the first cleaner 200 is coupled between the pair of guide protrusions 123, the battery housing 230 or battery 240 comes into contact with the coupling sensor 125, such that the coupling sensor 125 can detect that the first cleaner 200 is coupled to the cleaner station 100.

Meanwhile, the coupling sensor 125 can include a non-contact sensor. For example, the coupling sensor 125 can include an infrared (IR) sensor. In this case, the coupling sensor 125 can be disposed on the sidewall 124. Therefore, when the dust bin 220 or main body 210 of the first cleaner 200 passes the sidewall 124 and then reaches the coupling surface 121, the coupling sensor 125 can detect the presence of the dust bin 220 or main body 210.

The coupling sensor 125 can face the dust bin 220 or battery housing 230 of the first cleaner 200.

The coupling sensor 125 can determine whether the first cleaner 200 is coupled and power is applied to the battery 240 of the first cleaner 200.

The coupling part 120 can include the suction part guide surface 126. The suction part guide surface 126 can be disposed on the first outer wall surface 112*a*. The suction part guide surface 126 can be connected to the dust bin guide surface 122. The suction part 212 can be coupled to the suction part guide surface 126. A shape of the suction part guide surface 126 can correspond to the shape of the suction part 212.

The coupling part 120 can include fixing member entrance holes 127. The fixing member entrance holes 127 can be in the form of a long hole along the sidewalls 124 so that a fixing member 131 can enter and exit the fixing member entrance hole 127.

With this configuration, when the user couples the first cleaner 200 to the coupling part 120 of the cleaner station 100, the main body 210 of the first cleaner 200 can be stably disposed on the coupling part 120 by the dust bin guide surface 122, the guide protrusions 123, and the suction part guide surface 126. Therefore, it is possible to provide convenience when coupling the dust bin 220 and battery housing 230 of the first cleaner 200 to the coupling surface 121.

Referring to FIGS. 2 and 7, the fixing unit 130 according to the present disclosure will be described below.

The cleaner station 100 according to the present disclosure can include the fixing unit 130. The fixing unit 130 can be disposed on the sidewall 124. In addition, the fixing unit 130 can be disposed on a back surface to the coupling surface 121. The fixing unit 130 can fix the first cleaner 200 coupled to the coupling surface 121. Specifically, the fixing unit 130 can fix the dust bin 220 and battery housing 230 of the first cleaner 200 coupled to the coupling surface 121.

The fixing unit 130 can include the fixing members 131 configured to fix the dust bin 220 and battery housing 230 of the first cleaner 200, and a fixing part motor 133 configured to drive the fixing members 131. In addition, the fixing unit 130 can further include a fixing part link 135 configured to transmit power of the fixing part motor 133 to the fixing members 131.

The fixing members 131 can be disposed on the sidewall 124 of the coupling part 120 and provided on the sidewall 124 so as to reciprocate in order to fix the dust bin 220. Specifically, the fixing members 131 can be accommodated in the fixing member entrance holes 127.

The fixing members 131 can be disposed at both sides of the coupling part 120, respectively. For example, a pair of two fixing members 131 can be symmetrically disposed with respect to the coupling surface 121.

The fixing part motor 133 can provide power for moving the fixing members 131.

The fixing part links 135 can convert rotational motions of the fixing part motor 133 into reciprocating motions of the fixing members 131.

A stationary sealer 136 can be disposed on the dust bin guide surface 122 so as to seal the dust bin 220 when the first cleaner 200 is coupled. With this configuration, when the dust bin 220 of the cleaner 200 is coupled, the cleaner 200 can press the stationary sealer 136 by its own weight, such that the dust bin 220 and the dust bin guide surface 122 can be sealed.

The stationary sealer 136 can be disposed in an imaginary extension line of the fixing members 131. With this configuration, when the fixing part motor 133 operates and the fixing members 131 press the dust bin 220, a circumference of the dust bin 220 at the same height can be sealed.

According to the embodiment, the stationary sealer 136 can be disposed on the dust bin guide surface 122 and formed in the form of a bent line corresponding to an arrangement of a cover opening unit 150 to be described below.

Therefore, when the main body 210 of the first cleaner 200 is disposed on the coupling part 120, the fixing unit 130 can fix the main body 210 of the first cleaner 200. Specifically, when the coupling sensor 125 detects that the main body 210 of the first cleaner 200 is coupled to the coupling part 120 of the cleaner station 100, the fixing part motor 133 can move the fixing members 131 to fix the main body 210 of the first cleaner 200.

Through this, it is possible to improve suction power of the cleaner by preventing residual dust from remaining in the dust bin. In addition, residual dust is prevented from remaining in the dust bin so that odors caused by the residue can be removed.

A door unit 140 according to the present disclosure will be described below with reference to FIGS. 2 and 8.

The cleaner station 100 according to the present disclosure can include the door unit 140. The door unit 140 can be configured to open or close the dust passage hole 121*a*.

The door unit 140 can include a door 141, a door motor 142, and a door arm 143.

The door 141 can be hingedly coupled to the coupling surface 121 and can open or close the dust passage hole 121*a*. The door 141 can include a door main body 141*a*, a hinge part 141*b*, and an arm coupling part 141*c*.

The door main body 141*a* can be formed in a shape capable of blocking the dust passage hole 121*a*. For example, the door main body 141*a* can be formed in a shape similar to a circular plate shape, but is not limited thereto, and can be any shape. On the basis of a state in which the door main body 141*a* blocks the dust passage hole 121*a*, the hinge part 141*b* can be disposed at an upper side of the door main body 141*a*, and the arm coupling part 141*c* can be disposed at a lower side of the door main body 141*a*.

The door main body 141*a* can be formed in a shape capable of sealing the dust passage hole 121*a*. For example, an outer surface of the door main body 141*a*, which is exposed to the outside of the cleaner station 100, is formed to have a diameter corresponding to a diameter of the dust passage hole 121*a*, and an inner surface of the door main body 141*a*, which is disposed in the cleaner station 100, is formed to have a diameter greater than the diameter of the dust passage hole 121*a*. In addition, a level difference can be occurred between the outer surface and the inner surface. Meanwhile, one or more reinforcing ribs can protrude from the inner surface in order to connect the hinge part 141*b* and the arm coupling part 141*c* and reinforce a supporting force of the door main body 141*a*.

The hinge part 141*b* can be a means by which the door 141 is hingedly coupled to the coupling surface 121. The hinge part 141*b* can be disposed at an upper end of the door main body 141*a* and coupled to the coupling surface 121.

The arm coupling part 141*c* can be a means to which the door arm 143 is rotatably coupled. The arm coupling part 141*c* can be disposed at a lower side of the inner surface, and the door arm 143 can be rotatably coupled to the arm coupling part 141*c*.

With this configuration, when the door arm 143 pulls the door main body 141*a* in the state in which the door 141 closes the dust passage hole 121*a*, the door main body 141*a* is rotated about the hinge part 141*b* toward the inside of the cleaner station 100, such that the dust passage hole 121*a* can be opened. Meanwhile, when the door arm 143 pushes the door main body 141*a* in the state in which the dust passage hole 121*a* is opened, the door main body 141*a* is rotated about the hinge part 141*b* toward the outside of the cleaner station 100, such that the dust passage hole 121*a* can be closed.

The door motor 142 can provide power (e.g., rotational force) for rotating the door 141. Specifically, the door motor 142 can rotate the door arm 143 in a forward direction or a reverse direction. In this case, the forward direction can be a direction in which the door arm 143 pulls the door 141. Therefore, when the door arm 143 is rotated in the forward direction, the dust passage hole 121*a* can be opened. In addition, the reverse direction can be a direction in which the door arm 143 pushes the door 141. Therefore, when the door arm 143 is rotated in the reverse direction, at least a part of the dust passage hole 121*a* can be closed. The forward direction can be opposite to the reverse direction.

The door arm 143 can connect the door 141 and the door motor 142 and open or close the door 141 using the power generated from the door motor 142.

For example, the door arm 143 can include a first door arm 143*a* and a second door arm 143*b*. One end of the first door arm 143*a* can be coupled to the door motor 142. The first door arm 143*a* can be rotated by the power of the door motor 142. The other end of the first door arm 143*a* can be rotatably coupled to the second door arm 143*b*. The first door arm 143*a* can transmit a force transmitted from the door motor 142 to the second door arm 143*b*. One end of the second door arm 143*b* can be coupled to the first door arm 143*a*. The other end of the second door arm 143*b* can be coupled to the door 141. The second door arm 143*b* can open or close the dust passage hole 121*a* by pushing or pulling the door 141.

The door unit 140 can further include door opening/closing detecting parts 144. The door opening/closing detecting parts 144 can be provided in the housing 100 and can detect whether the door 141 is in an opened state.

For example, the door opening/closing detecting parts 144 can be disposed at both ends in a rotation region of the door arm 143, respectively. As another example, the door opening/closing detecting parts 144 can be disposed at both ends in a movement region of the door 141, respectively.

Therefore, when the door arm 143 is moved to a predetermined door opened position DP1 or when the door 141 is opened to a predetermined position, the door opening/closing detecting parts 144 can detect that the door is opened. In addition, when the door arm 143 is moved to a predetermined door closed position DP2 or when the door 141 is moved to a predetermined position, the door opening/closing detecting parts 144 can detect that the door is closed. In addition, in this embodiment, when the door arm 143 moves to a predetermined door flow rate control position DP3 or when the door 141 is rotated to a predetermined position, the door open/close detecting parts 144 can detect that the position where the flow rate of the air to be sucked by the dust collecting motor 191 can be changed has been reached.

The door opening/closing detecting parts 144 can include a contact sensor. For example, the door opening/closing detecting part 144 can include a micro-switch.

Meanwhile, the door opening/closing detecting part 144 can also include a non-contact sensor. For example, the door opening/closing detecting part 144 can include an infrared (IR) sensor.

With this configuration, the door unit 140 can selectively open or close at least a part of the coupling surface 121, thereby allowing the outside of the first outer wall surface 112*a* to communicate (e.g., fluidly communicate) with the first cleaner flow path part 181 and/or the dust collecting part 170.

The door unit 140 can be opened when the discharge cover 222 of the first cleaner 200 is opened. In addition, when the door unit 140 is closed, the discharge cover 222 of the first cleaner 200 can also be closed.

When the dust in the dust bin 220 of the first cleaner 200 is removed, the door motor 142 can rotate the door 141, thereby coupling the discharge cover 222 to the dust bin main body 221. Specifically, the door motor 142 can rotate the door 141 to rotate the door 142 about the hinge part 141*b*, and the door 142 rotated about the hinge part 141*b* can push the discharge cover 222 toward the dust bin main body 221.

The cover opening unit 150 according to the present disclosure will be described below with reference to FIGS. 2 and 9.

The cleaner station 100 according to the present disclosure can include the cover opening unit 150. The cover opening unit 150 can be disposed on the coupling part 120 and can open the discharge cover 222 of the first cleaner 200.

The cover opening unit 150 can include a push protrusion 151, a cover opening motor 152, cover opening gears (153*a* and 153*b*), a support plate 154, and a gear box 155.

The push protrusion 151 can move to press the coupling lever 222*c* when the first cleaner 200 is coupled.

The push protrusion 151 can be disposed on the dust bin guide surface 122. Specifically, a protrusion moving hole can be formed in the dust bin guide surface 122, and the push protrusion 151 can be exposed to the outside by passing through the protrusion moving hole.

When the first cleaner 100 is coupled, the push protrusion 151 can be disposed at a position at which the push protrusion 151 can push the coupling lever 222*c*. That is, the coupling lever 222*c* can be disposed on the protrusion moving hole. In addition, the coupling lever 222*c* can be disposed in a movement region of the push protrusion 151.

The push protrusion 151 can rectilinearly reciprocate to press the coupling lever 222*c*. Specifically, the push protrusion 151 can be coupled to the gear box 155, such that the rectilinear movement of the push protrusion 151 can be guided. The push protrusion 151 can be coupled to the cover opening gears (153*a* and 153*b*) and moved together with the cover opening gears (153*a* and 153*b*) by the movements of the cover opening gears (153*a* and 153*b*).

The cover opening motor 152 can provide power for moving the push protrusion 151. Specifically, the cover opening motor 152 can rotate a motor shaft in a forward direction or a reverse direction. In this case, the forward direction can be a direction in which the push protrusion 151 pushes the coupling lever 222*c*. In addition, the reverse direction can be a direction in which the push protrusion 151, which has pushed the coupling lever 222*c*, returns back to an original position. The forward direction can be opposite to the reverse direction.

The cover opening gear can be coupled to the cover opening motor 152 and can move the push protrusion 151 using the power from the cover opening motor 152. Specifically, the cover opening gears 153*a*/153*b* can be accommodated in the gear box 155. The driving gear 153*a* of the cover opening gears 153*a*/153*b* can be coupled to the motor shaft of the cover opening motor 152 to receive power. The driven gear 153*b* of the cover opening gears 153*a*/153*b* can be coupled with the push protrusion 151 to move the push protrusion 151. For example, the driven gear 153*b* is provided in the form of a rack gear so as to engage with the driving gear 153*a*, and can receive power from the driving gear 153*a*.

In this case, the discharge cover 222 can be provided with a torsion spring 222*d*. By the elastic force of the torsion spring 222*d*, the discharge cover 222 can be rotated at a predetermined angle or greater and supported in the rotated position. Accordingly, the discharge cover 222 can be opened, and the dust passage hole 121*a* can communicate (e.g., fluidly communicate) with the inside of the dust bin 220.

The gear box 155 can be provided inside the housing 110 and disposed at the lower side of the coupling part 120 in the gravitational direction, and the cover opening gears (153*a* and 153*b*) can be accommodated in the gear box 155.

A cover opening detecting part 155*f* can be provided in the gear box 155. In this case, the cover opening detecting part 155*f* can include a contact sensor. For example, the cover opening detecting part 155*f* can include a micro-switch. Meanwhile, the cover opening detecting part 155*f* can also include a non-contact sensor. For example, the cover opening detecting part 155*f* can include an infrared (IR) sensor.

At least one cover opening detecting part 155*f* can be disposed on an inner surface or outer surface of the gear box 155. For example, one cover opening detecting part 155*f* can be disposed on the inner surface of the gear box 155. In this case, the cover opening detecting part 155*f* can detect that the push protrusion 151 is in an initial position.

As another example, two cover opening detecting parts 155*f* can be disposed on the outer surface of the gear box 155. In this case, the cover opening detecting part 155*f* can detect the initial position of the push protrusion 151 and the cover opening position.

Accordingly, according to the present disclosure, the cover opening unit 150 can open the dust bin 220 even though the user separately opens the discharge cover 222 of the first cleaner, and as a result, it is possible to improve convenience.

In addition, since the discharge cover 222 is opened in the state in which the first cleaner 200 is coupled to the cleaner station 100, it is possible to prevent the dust from scattering.

Meanwhile, the dust collecting part 170 will be described below with reference to FIGS. 2 and 10.

The cleaner station 100 can include the dust collecting part 170. The dust collecting part 170 can be disposed in the housing 110. The dust collecting part 170 can be disposed at a lower side in the gravitational direction of the coupling part 120.

For example, the dust collecting part 170 can refer to a dust bag that collects dust sucked from the inside of the dust bin 220 of the first cleaner 200 by the dust collecting motor 191.

The dust collecting part 170 can be detachably coupled to the housing 110.

Therefore, the dust collecting part 170 can be separated from the housing 110 and discarded, and a new dust collecting part 170 can be coupled to the housing 110. That is, the dust collecting part 170 can be defined as a consumable component.

When a suction force is generated by the dust collecting motor 191, the dust bag can be configured to increase in volume and accommodate dust therein. To this end, the dust bag can be made of a material that transmits air but does not transmit foreign substances, such as dust (e.g., a material that filters dust and other foreign substances). For example, the dust bag can be made of a non-woven fabric material and can have a hexahedral shape based on when the volume is increased.

Therefore, it is not necessary for the user to separately bind a bag in which the dust is captured, and as a result, it is possible to improve convenience for the user.

Meanwhile, the cleaner station 100 according to the embodiment of the present disclosure can further include a sterilization module 175.

The sterilization module 175 can be provided on the flow path part 180 or at least one sterilization module 175 can be provided around the dust collecting part 170.

The sterilization module 175 is a component provided to sterilize the dust collected in the dust collecting part 170. The sterilization module 175 can include a light source for emitting sterilization light and a protective panel disposed below the light source to protect the light source.

Here, the light source can include at least one light emitting diode (LED) capable of emitting sterilization light having sterilization function capable of eliminating bacteria. The sterilization light emitted by the light source can have a wavelength that varies depending on the type of light emitting diode.

For example, the light source can be a light emitting diode that emits ultraviolet rays having a UV-C wavelength range. Ultraviolet rays are classified into UV-A (315 nm to 400 nm), UV-B (280 nm to 315 nm), and UV-C (200 nm to 280 nm) depending on the wavelength and among them, ultraviolet light in the UV-C region can damage the DNA double helix of microorganisms and inhibit the proliferation of microorganisms.

Alternatively, the light source can be a light emitting diode that emits visible light having a wavelength of 405 nm. Blue light having a wavelength of 405 nm has a wavelength in the boundary region of visible light and ultraviolet light, and its sterilization function has been proven.

The protective panel can be disposed on below the light source at a predetermined distance from the light source to prevent damage to the light source. In this case, the protective panel can be provided with a material that maximizes the transmittance of the light source. For example, the protective panel can be made of quartz. It is known that quartz does not interfere with the transmission of ultraviolet light in the UV-C region.

The cleaner station 100 according to an embodiment of the present disclosure includes the sterilization module 175 that sterilizes bacteria (e.g., destroys bacteria) so that bacteria do not proliferate in the dust collecting part 170, thereby hygienically managing the dust collecting part 170 that stores the sucked dust for a long period of time.

Meanwhile, the flow path part 180 will be described below with reference to FIGS. 2 and 10.

The cleaner station 100 can include the flow path part 180. The flow path part 180 can connect the first cleaner 200 or the second cleaner 300 to the dust collecting part 170. In a state in which the first cleaner 200 is coupled to the cleaner station 100, the internal space of the dust bin 200 of the first cleaner 200 can be connected to the flow path part 180 in a passage way, and when the door 141 and the discharge cover 222 is opened, the internal space of the dust bin 200 and the flow path part 180 can communicate (e.g., fluidly communicate) with each other.

The flow path part 180 can include the first cleaner flow path part 181, the second cleaner flow path part 182, and a flow path switching valve 183.

The first cleaner flow path part 181 can connect the dust bin 220 of the first cleaner 200 to the dust collecting part 170. The first cleaner flow path part 181 can be disposed at a rear side of the coupling surface 121. The first cleaner flow path part 181 can be a space between the dust bin 220 of the first cleaner 200 and the dust collecting part 170. The first cleaner flow path part 181 can be a space formed at a rear side of the dust passage hole 121*a*, or can be a flow path bent downward from the dust passage hole 121*a*, and the dust and the air can flow through the first cleaner flow path part 181.

Specifically, when the first cleaner 200 is coupled to the cleaner station 200 and the dust passage hole 121*a* is first opened, the first flow path 181*a* communicating with the internal space of the dust bin 220 and the second flow path 181*b* allowing the first flow path 181*a* to communicate (e.g., fluidly communicate) with the internal space of the dust collecting part 170 can be included.

For example, the first flow path 181*a* can be disposed substantially in parallel with the suction motor axis a1 or the dust bin through line a5. In this case, the suction motor axis a1 or the dust bin through line a5 can penetrate the first flow path 181.

In addition, the second flow path 181*b* can be disposed in a direction parallel to a dust collecting motor axis C. With this configuration, it is possible to minimize a decrease in suction force of the dust collecting motor 191 in the first flow path 181*a* and the second flow path 181*b*.

In this case, the first flow path 181*a* can be provided at a predetermined angle with respect to the second flow path 181*b*. For example, an angle between the first flow path 181*a* and the second flow path 181*b* can be a right angle (e.g., 90°). With this configuration, it is possible to minimize an overall volume of the cleaner station 100.

Meanwhile, a length of the first flow path 181*a* can be equal to or shorter than a length of the second flow path. With this configuration, the suction force of the dust collecting motor 191 can be transmitted to the space in the dust bin 220 even though the entire flow path for removing the dust is bent once.

The dust in the dust bin 220 of the first cleaner 200 can move to the dust collecting part 170 through the first cleaner flow path part 181.

The second cleaner flow path part 182 can connect the second cleaner 300 to the dust collecting part 170. The dust in the second cleaner 300 can move to the dust collecting part 170 through the second cleaner flow path part 182.

A flow path switching valve 183 can be disposed between the dust collecting part 170, the first cleaner flow path part 181, and the second cleaner flow path part 182. The flow path switching valve 183 can selectively open or close the first cleaner flow path part 181 and the second cleaner flow path part 182 connected to the dust collecting part 170. Therefore, it is possible to prevent a decrease in suction force caused when the plurality of flow paths 181 and 182 is opened.

For example, in a case in which only the first cleaner 200 is coupled to the cleaner station 100, the flow path switching valve 183 can connect the first cleaner flow path part 181 to the dust collecting part 170 and disconnect the second cleaner flow path part 182 from the dust collecting part 170.

Meanwhile, the dust suction module 190 will be described below with reference to FIGS. 2 and 10.

The cleaner station 100 can include the dust suction module 190. The dust suction module 190 can include the dust collecting motor 191, a first filter 192, and a second filter. The second filter can be in-line with the first filter, and can be a different type of filter, such as a carbon filter, a dust filter (higher micron level) or a HEPA filter.

The dust collecting motor 191 can be disposed below the dust collecting part 170. The dust collecting motor 191 can generate the suction force in the first cleaner flow path part 181 and the second cleaner flow path part 182. Therefore, the dust collecting motor 191 can provide the suction force capable of sucking the dust in the dust bin 220 of the first cleaner 200 and the dust in the second cleaner 300.

The dust collecting motor 191 can generate the suction force by means of the rotation. For example, the dust collecting motor 191 can be formed in a shape similar to a cylindrical shape.

Meanwhile, in the present embodiment, an imaginary dust collecting motor axis C can be formed by extending the rotation axis of the dust collecting motor 191.

The first filter 192 can be disposed between the dust collecting part 170 and the dust collecting motor 191. The first filter 192 can be a prefilter (e.g., a carbon filter, or any type of filter).

The second filter can be disposed between the dust collecting motor 191 and the outer wall surface 112. The second filter can be an HEPA filter.

Meanwhile, the cleaner station 100 can include a charging part 128. The charging part 128 can be disposed on the coupling part 120. The charging part 128 can be electrically connected to the first cleaner 200 coupled to the coupling part 120. The charging part 128 can supply power to the battery of the first cleaner 200 coupled to the coupling part 120.

In addition, the charging part 128 can include a lower charging part disposed in a lower region of the housing 110. The lower charging part can be electrically connected to the second cleaner 300 coupled to the lower region of the housing 110. A second charger can supply power to the battery of the second cleaner 300 coupled to the lower region of the housing 110.

In addition, the cleaner station 100 can include a lateral door. The lateral door can be disposed in the housing 110. The lateral door can selectively expose the dust collecting part 170 to the outside. Therefore, the user can easily remove the dust collecting part 170 from the cleaner station 100.

Meanwhile, FIG. 10 is a block diagram for explaining a control configuration of a cleaner station according to an embodiment of the present disclosure.

The control configuration of the cleaner station 100 according to the present disclosure will be described below with reference to FIG. 10.

The cleaner station 100 according to the embodiment of the present disclosure can further include a station control unit 400 configured to control the coupling part 120, the fixing unit 130, the door unit 140, the cover opening unit 150, the dust collecting part 170, the flow path part 180, and the dust suction module 190.

The station control unit 400 can include a printed circuit board, and elements mounted on the printed circuit board.

When the coupling sensor 125 detects the coupling of the first cleaner 200, the coupling sensor 125 can transmit a signal indicating that the first cleaner 200 is coupled to the coupling part 120. In this case, the station control unit 400 can receive the signal from the coupling sensor 125 and determine that the first cleaner 200 is coupled to the coupling part 120.

In addition, when the charging part 128 supplies power to the battery 240 of the first cleaner 200, the station control unit 400 can determine that the first cleaner 200 is coupled to the coupling part 120.

When the station control unit 400 determines that the first cleaner 200 is coupled to the coupling part 120, the station control unit 400 can operate the fixing part motor 133 to fix the first cleaner 200.

When the fixing members 131 or the fixing part links 135 are moved to the predetermined fixing point FP1, the fixing detecting part 137 can transmit a signal indicating that the first cleaner 200 is fixed. The station control unit 400 can receive the signal, which indicates that the first cleaner 200 is fixed, from the fixing detecting part 137 and determine that the first cleaner 200 is fixed. When the station control unit 400 determines that the first cleaner 200 is fixed, the station control unit 400 can stop the operation of the fixing part motor 133.

Meanwhile, when the operation of emptying the dust bin 200 is ended, the station control unit 400 can rotate the fixing part motor 133 in the reverse direction to release the fixing of the first cleaner 200.

When the station control unit 400 determines that the first cleaner 200 is fixed to the coupling part 120, the station control unit 400 can operate the door motor 142 to open the door 141 of the cleaner station 100.

When the door 141 or the door arm 143 reaches the predetermined opened position DP1, the door opening/closing detecting part 144 can transmit a signal indicating that the door 141 is opened. The station control unit 400 can receive the signal, which indicates that the door 141 is opened, from the door opening/closing detecting parts 144 and determine that the door 141 is opened. When the station control unit 400 determines that the door 141 is opened, the station control unit 400 can stop the operation of the door motor 142.

Meanwhile, when the operation of emptying the dust bin 200 is ended, the station control unit 400 can rotate the door motor 142 in the reverse direction to close the door 141.

When the station control unit 400 determines that the door 141 is opened, the station control unit 400 can operate the cover opening motor 152 to open the discharge cover 222 of the first cleaner 200.

When the guide frame 151*e* reaches the predetermined opened position CP1, the cover opening detecting part 155*f* can transmit a signal indicating that the discharge cover 222 is opened. The station control unit 400 can receive the signal, which indicates that the discharge cover 222 is opened, from the cover opening detecting part 155*f* and determine that the discharge cover 222 is opened. When the station control unit 400 determines that the discharge cover 222 is opened, the station control unit 400 can stop the operation of the cover opening motor 152.

The station control unit 400 can control the sterilization module 175. For example, the station control unit 400 operates the sterilization module 175 after dust is collected in the dust collecting part 170 or at predetermined time intervals to sterilize viruses or microorganisms existing inside or outside the dust collecting part 170.

The station control unit 400 can control the flow path switching valve 183 of the flow path part 180. For example, the station control unit 400 can selectively open or close the first cleaner flow path part 181 and the second cleaner flow path part 182.

The station control unit 400 can operate the dust collecting motor 191 to suck the dust in the dust bin 220.

The station control unit 400 can operate the display part 410 (e.g., a display, such as an LED screen or the like) to display the dust bin emptied situation and charged situation (e.g., charged state, such as a state of charge and/or whether the first cleaner or second cleaner 300) is being charged) of the first cleaner 200 or the second cleaner 300.

Meanwhile, the cleaner station 100 according to the present disclosure can include the display part 410.

The display part 410 can be disposed on the housing 110, disposed on a separate display device, or disposed on a terminal such as a mobile phone.

The display part 410 can be configured to include at least any one of a display panel capable of outputting text and/or figures and a speaker capable of outputting voice signals and sound. The user can easily ascertain a situation of a currently performed process, a residual time, and the like on the basis of information outputted through the display unit.

Meanwhile, the cleaner station 100 according to an embodiment of the present disclosure can include a memory 430. The memory 430 can include various data for driving and operating the cleaner station 100.

Meanwhile, the cleaner station 100 according to the embodiment of the present disclosure can include an input part 440. The input part 440 generates key input data input by the user to control the operation of the cleaner station 100. To this end, the input part 440 can include a key pad, a dome switch, and a touch pad (e.g., that operates by static pressure, capacitance, or any other method). In particular, when the touch pad and the display part 410 form a mutual layer structure, this can be referred to as a touch screen.

Meanwhile, a state in which the first cleaner 200 is coupled to the cleaner station 100 will be described with reference to FIGS. 2 and 3.

In the present disclosure, the first cleaner 200 can be mounted on the outer wall surface 112 of the cleaner station 100. For example, the dust bin 220 and battery housing 230 of the first cleaner 200 can be coupled to the coupling surface 121 of the cleaner station 100. That is, the first cleaner 200 can be mounted on the first outer wall surface 112*a*.

In this case, the suction motor axis a1 can be defined perpendicular to the first outer wall surface 112*a*. That is, the suction motor axis a1 can be defined in parallel with the ground surface. The suction motor axis a1 can be defined on a plane perpendicular to the ground surface. In addition, the suction motor axis a1 can be defined on a plane that perpendicularly intersects the first outer wall surface 112*a*.

The suction flow path through line a2 can be defined in parallel with the first outer wall surface 112*a*. The suction flow path through line a2 can be defined in the gravitational direction. That is, the suction flow path through line a2 can be defined to be perpendicular to the ground surface. In addition, the suction flow path through line a2 can be defined on the plane that perpendicularly intersects the first outer wall surface 112*a*.

The grip portion 216*a* through line a3 can be defined to be inclined at a predetermined angle with respect to the first outer wall surface 112*a*. In addition, the grip portion 216*a* through line a3 can be defined to be inclined at a predetermined angle with respect to the ground surface. The grip portion 216*a* through line a3 can be defined on the plane that perpendicularly intersects the first outer wall surface 112*a*.

The cyclone line a4 can be defined to be perpendicular to the first outer wall surface 112*a*. That is, the cyclone line a4 can be defined in parallel with the ground surface. The cyclone line a4 can be defined on the plane perpendicular to the ground surface. In addition, the cyclone line a4 can be defined on the plane that perpendicularly intersects the first outer wall surface 112*a*.

The dust bin through line a5 can be defined to be perpendicular to the first outer wall surface 112*a*. That is, the dust bin through line a5 can be defined in parallel with the ground surface. The dust bin through line a5 can be defined on the plane perpendicular to the ground surface. In addition, the dust bin through line a5 can be defined on the plane that perpendicularly intersects the first outer wall surface 112*a*.

The dust collecting motor axis C can be defined to be perpendicular to the ground surface. The dust collecting motor axis C can be defined in parallel with at least any one of the first outer wall surface 112*a*, the second outer wall surface 112*b*, the third outer wall surface 112*c*, and the fourth outer wall surface 112*d*.

When the first cleaner 200 is coupled to the cleaner station 100, the suction motor axis a1 can intersect a longitudinal axis of the cleaner station 100. That is, the rotation axis of the suction motor 214 can intersect the longitudinal axis of the cleaner station 100.

When the first cleaner 200 is coupled to the cleaner station 100, the suction motor axis a1 can intersect the dust collecting motor axis C.

In the state in which the first cleaner 200 and the cleaner station 100 are coupled, the suction motor axis a1 can intersect the dust collecting motor axis C at a predetermined angle. For example, an included angle θ1 between the suction motor axis a1 and the dust collecting motor axis C can be 40 degrees or more and 95 degrees or less.

In this case, the included angle can be an angle defined as the suction motor axis a1 and the dust collecting motor axis C intersect each other, that is, an included angle defined between the suction motor axis a1 and the dust collecting motor axis C.

Meanwhile, when the first cleaner 200 is coupled to the cleaner station 100, the handle 216 can be disposed to be farther from the ground surface than is the suction motor axis a1. With this configuration, when the user grasps the handle 216, the relatively heavy suction motor 214 is positioned at the lower side in the gravitational direction, and the user can couple or separate the first cleaner 200 to/from the cleaner station 100 only by simply moving the first cleaner 200 in the direction parallel to the ground surface. As a result, it is possible to provide convenience for the user.

In addition, when the first cleaner 200 is coupled to the cleaner station 100, the battery 240 can be disposed to be farther from the ground surface than is the suction motor axis a1. With this configuration, the first cleaner 200 can be stably supported on the cleaner station 100.

When the first cleaner 200 is coupled to the cleaner station 100, the suction flow path through line a2 can be defined in parallel with the dust collecting motor axis C. With this configuration, it is possible to minimize an occupied space on a horizontal plane in the state in which the first cleaner 200 is coupled to the cleaner station 100.

In this case, the coupling part 120 can be disposed between the suction flow path through line a2 and the dust collecting motor axis C. The fixing member 131 can be disposed between the suction flow path through line a2 and the dust collecting motor axis C. The cover opening unit 150 can be between the suction flow path through line a2 and the dust collecting motor axis C. With this configuration, the user can couple or separate the first cleaner 200 to/from the cleaner station 100, fix the dust bin 220, and open the dust bin 220 only by simply moving the first cleaner 200 in the direction parallel to the ground surface. As a result, it is possible to provide convenience for the user.

The grip portion through line a3 can intersect the dust collecting motor axis C at a predetermined angle. In this case, an intersection point P6 between the grip portion through line a3 and the dust collecting motor axis C can be positioned in the housing 110. This configuration is advantageous in that the user can couple the first cleaner 200 to the cleaner station 100 only by simply pushing his/her arm toward the lateral side of the cleaner station 100 in the state in which the user grasps the first cleaner 200. In addition, since the dust collecting motor 191, which is relatively heavy in weight, is accommodated in the housing 110, it is possible to prevent the cleaner station 100 from swaying even though the user strongly pushes the first cleaner 200 into the cleaner station 100.

When the first cleaner 200 is coupled to the cleaner station 100, the cyclone line a4 can intersect the longitudinal axis of the cleaner station 100. That is, the flow axis of the dust separating part 213 can intersect the longitudinal axis of the cleaner station 100. In this case, the intersection point between the flow axis of the dust separating part 213 and the longitudinal axis of the cleaner station 100 can be positioned in the housing 110, and more particularly, positioned in the flow path part 180.

When the first cleaner 200 is coupled to the cleaner station 100, the cyclone line a4 can intersect the dust collecting motor axis C. In this case, the intersection point between the cyclone line a4 and the dust collecting motor axis C can be positioned in the housing 110, and more particularly, positioned in the flow path part 180. With this configuration, the first cleaner 200 can be stably supported on the cleaner station 100 in the state in which the first cleaner 200 is coupled to the cleaner station 100, and a loss of flow path can be reduced during the operation of emptying the dust bin 220.

When the first cleaner 200 is coupled to the cleaner station 100, the dust bin through line a5 can intersect the longitudinal axis of the cleaner station 100. That is, the longitudinal axis of the dust bin 220 can intersect the longitudinal axis of the cleaner station 100. In this case, an intersection point between the longitudinal axis of the dust bin 220 and the longitudinal axis of the cleaner station 100 can be positioned in the housing 110, and more particularly, positioned in the flow path part 180.

Meanwhile, when the first cleaner 200 is coupled to the cleaner station 100, the handle 216 can be disposed to be farther from the ground surface than is the dust bin through line a5. With this configuration, when the user grasps the handle 216, the user can couple or separate the first cleaner 200 to/from the cleaner station 100 only by simply moving the first cleaner 200 in the direction parallel to the ground surface. As a result, it is possible to provide convenience for the user.

In addition, when the first cleaner 200 is coupled to the cleaner station 100, the battery 240 can be disposed to be farther from the ground surface than is the dust bin through line a5. In this configuration, because the battery 240 pushes the main body 210 of the first cleaner 200 by means of the weight of the battery 240, the first cleaner 200 can be stably supported on the cleaner station 100.

FIG. 11 is a flowchart for explaining a method of controlling a cleaner station according to the present disclosure, and FIG. 12 is a view for explaining an operation of controlling each motor over time in a method of controlling a cleaner station according to a first embodiment of the present disclosure.

The first embodiment of the method of controlling a cleaner station according to the present disclosure will be described below with reference to FIGS. 10 to 13.

A method of controlling a cleaner station according to the present disclosure includes a coupling checking step S10, a dust bin fixing step S20, a cover opening step S30, a door opening step S40, a dust collecting step S50, an additional duct collecting step S60, a door closing checking step S70, and a fixation releasing step S80.

In the coupling checking step S10, whether the first cleaner 200 is coupled to the coupling part 120 of the cleaner station 100 can be checked.

Specifically, in the coupling checking step S10, when the first cleaner 200 is coupled to the cleaner station 100, the coupling sensor 125 disposed on the guide protrusion 123 can come into contact with the battery housing 230, and the coupling sensor 125 can transmit a signal indicating that the first cleaner 200 is coupled to the coupling part 120. Alternatively, the coupling sensor 125 of a non-contact sensor type disposed on the sidewall 124 according to an embodiment can detect the presence of the dust bin 220, and the coupling sensor 125 can transmit a signal indicating that the first cleaner 200 is coupled to the coupling part 120.

Therefore, in the coupling checking step S10, the station control unit 400 can receive the signal generated by the coupling sensor 125 and determine that the first cleaner 200 is coupled to the coupling part 120.

Meanwhile, in the coupling checking step S10 according to the present disclosure, the station control unit 400 can determine whether the first cleaner 200 is coupled at the exact position on the basis of whether the charging part 128 supplies power to the battery 240 of the first cleaner 200.

Therefore, in the coupling checking step S10, the station control unit 400 can receive the signal from the coupling sensor 125, which indicates that the first cleaner 200 is coupled, and check whether the charging part 128 supplies power to the battery 240, thereby checking whether the first cleaner 200 is coupled to the coupling part 120 of the cleaner station 100.

In the dust bin fixing step S20, when the first cleaner 200 is coupled to the cleaner station 100, the fixing member 131 can hold and fix the dust bin 220.

Specifically, when the station control unit 400 receives the signal, which indicates that the first cleaner 200 is coupled, from the coupling sensor 125, the station control unit 400 can operate the fixing part motor 133 in the forward direction so that the fixing member 131 is fixed to the dust bin 220. In this case, when the fixing member 131 or the fixing part link 135 is moved to the dust bin fixing position FP1, the first fixing detecting part 137 can transmit a signal indicating that the first cleaner 200 is fixed to the station control unit 400. Therefore, the station control unit 400 can receive the signal from the first fixing detecting part 137, which indicates that the first cleaner 200 is fixed, and determine that the first cleaner 200 is fixed. When the station control unit 400 determines that the first cleaner 200 is fixed, the station control unit 400 can stop the operation of the fixing part motor 133.

Additionally, the station control unit 400 can stop the operation of the fixing part motor 133 after operating the fixing part motor 133 in the forward direction for a predetermined fixed time tf. For example, the station control unit 400 can stop the operation of the fixing part motor 133 after operating the fixing part motor 133 in the forward direction for a period of 4 seconds or more and 5 seconds or less.

In the cover opening step S30, when the dust bin 220 is fixed to the cleaner station 100, the station control unit 400 can open the discharge cover 222 of the first cleaner 200.

When the station control unit 400 receives the signal, which indicates that the dust bin 220 is fixed, from the first fixing detecting part 137, the station control unit 400 can operate the cover opening motor 152 in the forward direction to open the discharge cover 222 in step S40.

Specifically, the station control unit 400 can operate the cover opening motor 152 in the forward direction. As a result, the push protrusion 151 can move out of its initial position to a position where the push protrusion 151 presses the coupling lever 222*c*. Therefore, the hook coupling between the discharge cover 222 and the dust bin main body 221 is released by the movement of the coupling lever 222*c*, and the discharge cover 222 can be separated from the dust bin main body 221 while rotating in the direction away from the dust bin main body 221 by the restoring force of the torsion spring 222*d*. In this case, the internal space of the dust bin 200 and the dust passage hole 121*a* can communicate (e.g., fluidly communicate) with each other.

Meanwhile, before the push protrusion 151 presses the coupling lever 222*c*, the cover opening detecting part 155*f* can transmit a signal indicating that the push protrusion 151 is at an initial position.

When the cover opening motor 152 is operated and the push protrusion 151 starts to move to press the coupling lever 222*c*, the cover opening detecting part 155*f* can transmit a signal indicating that the push protrusion 151 is out of its initial position. Then, the station control unit 400 can receive this signal and determine that the cover opening unit 150 is normally operated.

In this case, the station control unit 400 can measure the time by a timer after operating the cover opening motor 152 in the forward direction or can measure the time after the push protrusion 151 moves out of its initial position.

In this case, the station control unit 400 can be preset or prestored with the time required for the push protrusion 151 to start from its initial position and press the coupling lever 222*c*, on the basis of the rotation speed of the cover opening motor 152 and the moving distance of the push protrusion 151. Accordingly, the station control unit 400 can operate the cover opening motor 152 in the forward direction for a cover opening time tc1 greater than or equal to the time required until the coupling lever 222*c* is pressed. For example, the station control unit 400 can operate the cover opening motor 152 in the forward direction for a period of 4 seconds or more and 5 seconds or less.

After the cover opening time tc1 has elapsed, the station control unit 400 can change the rotation direction of the cover opening motor 152 for a predetermined rotation direction change time tc2.

Also, the station control unit 400 can operate the cover opening motor 152 in the reverse direction after the rotation direction change time tc2 has elapsed. As a result, the push protrusion 151 can return to the initial position.

The station control unit 400 can operate the cover opening motor 152 until the cover opening detecting part 155*f* detects that the push protrusion 151 has returned to its initial position. In this case, the station control unit 400 can be preset and prestored with the protrusion return time tc3 required until the push protrusion 151 returns to the initial position after the push protrusion 151 presses the coupling lever 222*c*. Accordingly, the station control unit 400 can operate the cover opening motor 152 in the reverse direction during the protrusion return time tc3. For example, the station control unit 400 can operate the cover opening motor 152 in the reverse direction for a period of 4 seconds or more and 5 seconds or less.

Meanwhile, when receiving a signal indicating that the push protrusion 151 has returned to the initial position from the cover opening detecting part 155*f*, the station control unit 400 can end the operation of the cover opening motor 152.

In the door opening step S40, the station control unit 400 can open the door 141 when the dust bin 220 is fixed to the cleaner station 100. Meanwhile, the door opening step S40 can be performed simultaneously with the cover opening step S30.

Specifically, when the station control unit 400 receives the signal, which indicates that the dust bin 220 is fixed, from the fixing detecting part 137, the station control unit 400 can operate the door motor 142 in the forward direction to open the dust passage hole 121*a* while the door 141 rotates. That is, in the door opening step S30, the station control unit 400 can rotate the door 141 to open the dust passage hole 121*a*. In this case, the dust passage hole 121*a* and the flow path part 180 can communicate (e.g., fluidly communicate) with each other.

Meanwhile, in the present embodiment, the station control unit 400 receives a signal, which indicates that the dust bin 220 is fixed, from the fixing detecting part 137, and then, after a predetermined time has elapsed, can operate the door motor 142 in the forward direction. For example, the station control unit 400 can operate the door motor 142 after 0.5 seconds or more and 1.5 seconds or less.

With this configuration, in the cover opening step S30, the station control unit 400 can open the door 141 after waiting for the time required for the push protrusion 151 to start pressing the coupling lever 222*c*, so that the discharge cover 222 and the door 141 can be opened around the same time. Accordingly, in a state in which the door 141 first rotates and the dust passing hole 121*a* is opened, even though the discharge cover 222 is suddenly opened by the restoring force of the torsion spring 222*d* and the door 141 and the discharge cover 222 strongly collide or the hook coupling between the discharge cover 222 and the dust bin main body 221 is released, the door 141 is not opened so that it is possible to prevent the discharge cover 222 and the dust bin main body 221 from being separated.

Meanwhile, the station control unit 400 can rotate the door 141 in stages to open the dust passage hole 121*a*. Specifically, the station control unit 400 can rotate the door 141 by a predetermined first opening angle θ1 and then stop the rotation of the door 141 for a predetermined time. For example, the station control unit 400 can rotate the door 141 by 25 degrees or more and 35 degrees or less, and then can stop the rotation of the door 141 for a period of 4 seconds or more and 5 seconds or less.

In this case, the rotation angle of the door 141 can be an angle at which the door 141 is rotated around the hinge axis hingedly coupled to the housing 110, on the basis of the position when the door 141 blocks the dust passage hole 121*a*.

The station control unit 400 can further rotate the door 141 by a predetermined second opening angle θ2 after the rotation of the door 141 stops for a predetermined time. For example, the station control unit 400 can further rotate the door 141 by 45 degrees or more and 55 degrees or less S43.

As a result, as the cover opening step S30 and the door opening step S40 proceed, the internal space of the dust bin main body 221 is opened while the discharge cover 222 of the dust bin 220 rotates, and the dust passage hole 121*a* is opened while the door 141 rotates. Accordingly, the internal space of the dust bin 220 can communicate (e.g., fluidly communicate) with the flow path part 180 (specifically, the first cleaner flow path part 181) of the cleaner station 100. That is, when the cover opening step S30 and the door opening step S40 proceed, the internal space of the dust bin 220 and the dust passage hole 121*a* are opened and communicated with each other by the rotation of the discharge cover 222, and the dust passage hole 121*a* and the flow path part 180 communicates with each other while the door 141 rotates, so that the internal space of the dust bin 220 and the flow path part 180 of the cleaner station 100 can communicate (e.g., fluidly communicate) to each other (see FIG. 13B).

Meanwhile, when the door arm 143 is moved to the predetermined door opened position DP1, the door opening/closing detecting parts 144 can detect this movement, and transmit a corresponding signal. Accordingly, the station control unit 400 can determine that the door 141 is opened, and can stop the operation of the door motor 142.

Alternatively, according to an embodiment, the station control unit 400 can detect that the door 141 has sufficiently rotated through a current value or the like applied to the door motor 142 (e.g., a current value that is sensed by a current sensor, as known in the art), and can determine that the door 141 is opened on the basis of the detection and stop the operation of the door motor 142.

In the dust collecting step S50, when the discharge cover 222 is opened and the door 141 rotates and the dust passage hole 121*a* is opened, the dust collecting motor 191 can operate to collect the dust in the dust bin 220.

The station control unit 400 can operate the dust collecting motor 191 when a predetermined dust collecting standby time tw has elapsed after the dust bin 220 is fixed.

For example, the station control unit 400 can start the operation of the dust collecting motor 191 when a time of 6 seconds or more and 7 seconds or less has elapsed after the dust bin is fixed. In this case, the station control unit 400 can gradually increase the rotation speed of the dust collecting motor 191 up to a predetermined dust collecting speed Ws for a predetermined suction increase time tsi. For example, the station control unit 400 can gradually increase the rotation speed of the dust collecting motor 191 up to the dust collecting speed Ws for a period of 3 seconds or more and 5 seconds or less. This has the advantage of increasing the lifespan of the dust collecting motor 191 by protecting the dust collecting motor 191.

As another example, the station control unit 400 can start the operation of the dust collecting motor 191 when a time of 10 seconds or more and 11 seconds or less has elapsed after the dust bin is fixed. In this case, the station control unit 400 can increase the suction power by increasing the rotation speed of the dust collecting motor 191 up to a predetermined dust collecting speed Ws. This has the advantage of minimizing the operation time of the dust collecting motor 191 to increase energy efficiency and minimize noise generation.

In the dust collecting step S50, the station control unit 400 can operate the dust collecting motor 191 to rotate at the dust collecting speed Ws for a predetermined dust collecting time ts2. For example, in the dust collecting step S50, the station control unit 400 can operate the dust collecting motor 191 to rotate at the dust collecting speed Ws for a period of 14 seconds or more and 16 seconds or less, but is not limited thereto. Depending on the output of the dust collecting motor 191 and the amount of dust stored in the dust bin 220, the dust collecting time ts1 can be changed and set S52.

In the dust collecting step S50, the dust in the dust bin 220 can pass through the dust passage hole 121*a* and the first cleaner flow path part 181 and then be collected in the dust collecting part 170. Therefore, the user can remove the dust in the dust bin 220 without a separate manipulation, and as a result, it is possible to provide convenience for the user.

In the additional dust collecting step S60, after the dust collecting step S50, there is an advantage in that the flow rate of air passing through the dust passage hole 121*a* is changed to suck in dirt, such as hair and dust, that is remaining inside the dust bin 220 and around the cyclone filter 219.

In the additional dust collecting step S60, the station control unit 400 can operate the door motor 142 while the dust collecting motor 191 is operating. That is, in the additional dust collecting step S60, the station control unit 400 can operate the dust collecting motor 191 during the dust collecting time ts1 in the dust collecting step S50, and then can operate the door motor 142 in a state in which the dust collecting motor 191 is maintained.

Specifically, the rotation speed of the dust collecting motor 191 in the additional dust collecting step S60 can maintain the rotation speed of the dust collecting motor 191 in the dust collecting step S50. That is, when the door motor 142 is operated in the additional dust collecting step S60, the rotation speed of the dust collection motor 191 can be operated while maintaining the dust collecting speed Ws.

Therefore, according to the present embodiment, since the rotation speed of the dust collecting motor 191 is maintained in the dust collecting step S50 and the additional dust collecting step S60, the velocity of the air passing through the dust passage hole 121*a* is also maintained in the dust collecting step S50 and the additional dust collecting step S60.

Meanwhile, in the additional dust collecting step S60, the station control unit 400 can operate the dust collecting motor 191 to rotate at the dust collecting speed Ws for a predetermined additional dust collecting time ts2. For example, in the additional dust collecting step S60, the station control unit 400 can operate the dust collecting motor 191 to rotate at the dust collecting speed Ws for a period of 11 seconds or more and 13 seconds or less.

In the additional dust collecting step S60, the station control unit 400 can operate the door motor 142 to rotate the door 141. In this case, the door 141 can rotate to a position where the flow rate of the air sucked by the dust collecting motor 191 can be changed.

That is, when the door arm 143 moves to a predetermined flow rate control position DP3, the door opening/closing detecting part 144 can detect this movement and transmit a corresponding signal. Accordingly, the station control unit 400 can determine that the door 141 has rotated to a position where the flow rate of air can be changed, and can stop the operation of the door motor 142.

Alternatively, according to an embodiment, the station control unit 400 can determine that the door 141 reaches a position where the flow rate of air can be changed by using the rotation speed of the door motor 142 and the operation time of the door motor 142, and can stop the operation of the door motor 142.

In the additional dust collecting step S60, the door 141 can rotate within an angle range of 10 degrees or more and 90 degrees or less based on the closed position Ps where the dust passage hole 121*a* is blocked.

Specifically, the door 141 rotates from the closed position Ps to the open position Po in the door opening step S40, and then maintains the open position Po in the dust collecting step S60, and rotates to the flow rate change position Pc in the additional dust collecting step S60. In this case, the angle from the closed position Ps to the open position Po can be greater than the angle from the closed position Ps to the flow rate change position Pc. For example, the angle $\alpha$ from the closed position Ps to the open position Po can be 70 degrees or more and 90 degrees or less, and the angle $\beta$ from the closed position Ps to the flow rate change position Pc can be 10 degrees or more and 35 degrees or less. That is, the angle $\alpha$-$\beta$ from the open position Pc to the flow rate change position Pc can be 10 degrees or more and 90 degrees or less based on the closed position Ps.

In the additional dust collecting step S60, the discharge cover 222 can be rotated in conjunction with the rotation of the door 141.

The discharge cover 222 can rotate from the open position Po to the flow rate change position Pc in a state in which the dust collecting motor 191 is operated. In this case, the position of the discharge cover 222 can be represented as an angle formed between one end of the dust bin main body 221 in the longitudinal direction (e.g., an end in the direction of the cleaner station) and the discharge cover 222 in a state in which the dust bin 220 is coupled to the cleaner station 100. Accordingly, a position of the discharge cover 222 when the discharge cover 222 is coupled to the dust bin main body 221 to close the dust bin 220 can be referred to as a cover closing position. Further, since the discharge cover 222 rotates together with the door 141 in a state of contact with each other in conjunction with the rotation of the door 141, the open position Po and flow rate change position Pc of the door 141 can also be used for the cover open position and cover flow rate change position of the discharge cover 222.

Therefore, in the additional dust collecting step S60, the angle formed between the discharge cover 222 and one end of the dust bin main body 221 in the longitudinal direction at the cover flow rate change position can be smaller than the angle formed between the discharge cover 222 and one end of the dust bin main body 221 in the longitudinal direction at the cover open position. For example, the angle $\beta$ formed between one end of the dust bin main body 221 in the longitudinal direction and the discharge cover 222 at the cover flow rate change position can be 10 degrees or more and 35 degrees or less, and the angle $\alpha$ formed between one end of the dust bin main body 221 in the longitudinal direction and the discharge cover 222 at the cover open position can be 70 degrees or more and 90 degrees or less.

Therefore, in the additional dust collecting step S60, the open area of the dust passage hole 121*a* can be changed by the rotation of the door 141 while the dust collecting motor 191 is operating. In addition, the open area of the dust passage hole 121*a* can be changed by the rotation of the discharge cover in conjunction with the door 141. In addition, in the additional dust collecting step S60, the area in which the internal space of the dust bin 220 is opened can also be changed (see FIG. 13*c*).

With this configuration, in the additional dust collecting step S60, the flow rate of air passing through the dust passage hole 121*a* can be changed in a state in which the dust collecting motor 191 is operated at the dust collecting speed Ws. Specifically, the flow rate of air passing through the dust passage hole 121*a* in the additional dust collecting step S60 can be higher than the flow rate of air passing through the dust passage hole 121*a* in the dust collecting step S50. That is, in the present embodiment, the velocity of air passing through the dust passage hole 121*a* is maintained while the open area of the dust passage hole 121*a* changes, so the flow rate of air passing through the dust passage hole 121*a* changes.

Therefore, in the present embodiment, an effect similar to dusting the dust bin 220 can be occurred, and the effect of removing dust and hair that can stick to the dust bin 220 or remain stuck in the cyclone filter 219 can be improved.

Meanwhile, in the additional dust collecting step S60, the station control unit 400 can change the flow rate of air passing through the dust passage hole 121*a* for a predetermined flow rate change time tv. For example, in the additional dust collecting step S60, the station control unit 400 can change the flow rate of air passing through the dust passage hole 121*a* for a period of 8 seconds or more and 10 seconds or less.

Meanwhile, in the additional dust collecting step S60, the station control unit 400 can operate the door motor 142 in the reverse direction after the flow rate change time tv has elapsed. In this case, the door 141 can be rotated to the closed position Ps. Accordingly, the door 141 can close the dust passage hole 121*a*, and the internal space of the dust bin 220 does not communicate (e.g., fluidly communicate) with the flow path part 180.

Meanwhile, in this embodiment, after the step of changing the flow rate of air passing through the dust passage hole 121*a* is performed, the step of closing the dust passage hole 121*a* is performed. Each step can be temporally distinct from each other. That is, a time interval can exist between the step of changing the flow rate of air passing through the dust passage hole 121*a*, and the step of closing the dust passage hole 121*a*, and the operation of the door motor 142 can be stopped during the time interval.

In addition, the step of changing the flow rate of air passing through the dust passage hole 121*a* can be distinguished from the step of closing the dust passage hole 121*a* in terms of the velocity of air passing through the dust passage hole 121*a*. That is, the step S61 of changing the flow rate of air passing through the dust passage hole 121*a* maintains the velocity in the dust collecting step S50 but changes the flow rate. On the contrary, in the step of closing the dust passage hole 121*a*, the air does not pass through the dust passage hole 121*a*, which is difference from the step S61 of changing the flow rate of air passing through the dust passage hole 121*a*.

That is, when the door arm 143 moves to the predetermined door closing position DP2, the door opening/closing detecting part 144 can detect this movement and transmit a corresponding signal. Accordingly, the station control unit 400 can determine that the door 141 has rotated to a position where the dust passage hole 121*a* can be blocked, and can stop the operation of the door motor 142.

Alternatively, according to an embodiment, the station control unit 400 can detect that the door 141 has rotated sufficiently to block the dust passage hole 121*a* through the current value applied to the door motor 142 or the like, and based on this, the station control unit 400 can determine that the door 141 blocks the dust passage hole 121*a*, and stop the operation of the door motor 142.

Therefore, in the additional dust collecting step S60, the operation of the dust collecting motor 191 can be maintained in a state in which the dust passage hole 121*a* is blocked. For example, in the additional dust collecting step S60, the operation of the dust collecting motor 191 can be maintained while the dust passage hole 121*a* is blocked for a period of 2 seconds or more and 4 seconds or less.

In this case, the dust passage hole 121*a* is closed so that the dust in the dust bin 220 is not collected, while dust remaining around the dust bin 220 can be sucked into the dust collecting part 170 through the bypass passage due to the negative pressure generated by the operation of the dust collecting motor 191.

Meanwhile, in the additional dust collecting step S60, the station control unit 400 can stop the dust collecting motor 191 when the additional dust collecting time ts2 has elapsed.

In this case, the station control unit 400 can gradually decrease the rotation speed of the dust collecting motor 191 from the dust collecting speed Ws for a predetermined suction reduction time tsd. For example, the station control unit 400 can gradually decrease the rotation speed of the dust collecting motor 191 from the dust collecting speed Ws for a period of 1 second or more and 3 seconds or less. This has the advantage of increasing the lifetime of the dust collecting motor 191 by protecting the dust collecting motor 191.

Alternatively, the station control unit 400 can immediately cut off the power applied to the dust collecting motor 191. This has the advantage of minimizing the operation time of the dust collecting motor 191 to increase energy efficiency and minimize noise generation.

Therefore, in the present disclosure, remaining hair, dust, etc. can be removed through the additional dust collecting step S60.

When the dust collecting motor is operated in a state in which the dust bin and the dust passage hole are sufficiently opened as in the conventional art, hair, dust, or the like can adhere to the dust bin or be trapped in the cyclone filter due to static electricity. In this case, the user can check that dust or hair remains inside the dust bin even after dust collection has been performed, and can recognize that the dust collection has not been performed properly.

In contrast, in the additional dust collecting step S60 of the present disclosure, the station control unit 400 rotates the door 141 while rotating the dust collecting motor 191 at a constant rotation speed to reduce the open area of the dust passage hole 121*a*. Therefore, by rotating the dust collecting motor 191 at a constant rotation speed, the velocity of the air flowing inside the dust bin 220 and through the dust passage hole 121*a* can be constantly maintained and the space the air passes through can be reduced (see FIG. 16).

With this configuration, in the additional dust collecting step S60, the flow rate of air flowing inside the dust bin 220 and through the dust passage hole 121*a* can be increased, and even fine dust or hair can be sucked in.

In addition, since the flow rate of air flowing through the flow path part 180 is increased, there is an effect of removing the dirt attached to the protective panel (e.g., a transmission window) of the sterilization module 175 provided for sterilization of the dust collecting part 170.

Meanwhile, in the additional dust collecting step S60, the station control unit 400 rotates the door 141 while the dust collecting motor 191 is operating, and it is also possible to change the rotation direction of the door 141 at least once.

Specifically, in the additional dust collecting step S60, the door 141 can be reciprocally rotated from the open position Po to the flow rate change position Pc.

With this configuration, the flow rate of air discharged from the dust bin 220 and passing through the dust passage hole 121*a* can continuously change. Therefore, in the present embodiment, an effect similar to that of continuously dusting the dust bin 220 can be occurred, and an effect of removing dust and hair that can stick to the dust bin 220 or remain stuck in the cyclone filter 219 can be improved.

Meanwhile, in the control method of the cleaner station according to an embodiment of the present disclosure, after the operation of the dust collecting motor 191 is ended, a door closing checking step of rotating the door 141 and opening at least a part of the dust passage hole 121*a*, and then re-blocking the dust passage hole 121*a* can be further included.

Specifically, the station control unit 400 can rotate the door motor 142 in the forward direction and then in the reverse direction again when a predetermined suction end time tse has elapsed after the operation of the dust collecting motor 191 is ended.

For example, the station control unit 400 operates the door motor 142 in the forward direction when a time of 3 seconds or more and 11 seconds or less, preferably 9 seconds or more and 11 seconds or less has elapsed after the operation of the dust collecting motor 191 is ended, and can rotate the door 141 to the flow rate change position Pc. After that, the station control unit 400 can operate the door motor 142 in the reverse direction to rotate the door 141 to the closed position Ps.

This is because, in the additional dust collecting step S60, the dust collecting motor 191 is operated with the dust passage hole 121*a* closed, so the slight opening of the dust passage hole 121*a* is blocked by the negative pressure generated by the operation of the dust collecting motor 191. Therefore, according to the door closing checking step S70, there is an effect in that after the operation of the dust collecting motor 191 is ended, the door 141 once again blocks the dust passage hole 121*a* to prevent the reverse flow of the dust that can exist on the flow path part 180.

In the fixation releasing step S80, when the door 141 is closed, the fixing part motor 133 can be operated, such that the fixing member 131 can release the fixing of the dust bin 220.

Specifically, when the station control unit 400 receives the signal, which indicates that the door 141 blocks the dust passage hole 121*a*, from the door opening/closing detecting part 144, the station control unit 400 can release the fixing of the dust bin 220.

That is, when the door arm 143 is moved to the predetermined door closed position DP2, the door opening/closing detecting part 144 detects this movement, and can transmit a corresponding signal. Accordingly, the station control unit 400 can determine that the door 141 has blocked the dust passage hole 121*a* and can operate the fixing part motor 133 in the reverse direction to release the fixing of the dust bin 220.

Alternatively, according to an embodiment, the station control unit 400 can detect that the door 141 has rotated sufficiently to block the dust passage hole 121*a* through a current value applied to the door motor 142, and the like. Based on this, the station control unit 400 can determine that the door 141 has blocked the dust passage hole 121*a*, and can operate the fixing part motor 133 in the reverse direction to release the fixing of the dust bin 220.

In this case, when the fixing member 131 or the fixing part link 135 is moved to the fixing release position FP2, the fixing detecting part 137 can transmit a signal indicating that the fixing of the first cleaner 200 is released.

Therefore, the station control unit 400 can receive the signal, which indicates that the fixing of the first cleaner 200 is released, from the fixing detecting part 137 and determine that the fixing of the first cleaner 200 is released.

When the station control unit 400 determines that the fixing of the first cleaner 200 is released, the station control unit 400 can stop the operation of the fixing part motor 133.

Unlike this, according to an embodiment, the station control unit 400 can operate the door motor 142 for a predetermined time. For example, the station control unit 400 can stop the operation of the door motor 142 after operating the door motor 142 in the reverse direction for a period of 4 seconds or more and 5 seconds or less.

Meanwhile, FIG. 14 is a view for explaining an operation of controlling each motor over time in a method of controlling a cleaner station according to a second embodiment of the present disclosure.

The method of controlling the cleaner station according to the second embodiment of the present disclosure includes a coupling checking step, a dust bin fixing step, a cover opening step, a door opening step, a dust collecting step, an additional dust collecting step, a door closing checking step, and a fixing release step.

In order to avoid a repeated description, the contents related to the coupling checking step S10, the dust bin fixing step S20, the cover opening step S30, the door opening step S40, the dust collecting step S50, the door closing checking step S70, and the fixation releasing step S80 in the method of controlling a cleaner station according to the first embodiment of the present disclosure can be used to describe the coupling checking step, the dust bin fixing step, the cover opening step, the door opening step, the dust collecting step, the door closing checking step, and the fixing release step according to the second embodiment.

In the additional dust collecting step, the station control unit 400 can operate the door motor 142 while the dust collecting motor 191 is operating. That is, in the additional dust collecting step, the station control unit 400 can operate the door motor 142 in a state in which the operation of the dust collecting motor 191 is maintained after the dust collecting motor 191 is operated during the dust collecting time ts1 in the dust collecting step.

Specifically, the rotation speed of the dust collecting motor 191 in the additional dust collection step of the present embodiment can be smaller than the rotation speed of the dust collecting motor 191 in the dust collection step. That is, when the door motor 142 is operated in the additional dust collection step, the rotational speed of the dust collection motor 191 can be operated at an additional dust collection speed Ws2 smaller than the dust collection speed Ws.

Meanwhile, in the additional dust collecting step, the station control unit 400 can operate the dust collecting motor 191 to rotate at the dust collecting speed Ws for a predetermined additional dust collecting time ts2. For example, in the additional dust collecting step, the station control unit 400 can operate the dust collecting motor 191 to rotate at the dust collecting speed Ws2 for a period of 3 seconds or more and 5 seconds or less.

In the additional dust collecting step, the station control unit 400 can operate the door motor 142 to rotate the door 141. In this case, the door 141 can be rotated to the closed position Ps.

That is, when the door arm 143 moves to the predetermined door closing position DP2, the door opening/closing detecting part 144 can detect this movement and transmit a corresponding signal. Accordingly, the station control unit 400 can determine that the door 141 has rotated to a position where the dust passage hole 121*a* can be blocked, and can stop the operation of the door motor 142.

Alternatively, according to an embodiment, the station control unit 400 can detect that the door 141 has rotated sufficiently to block the dust passage hole 121*a* through the current value applied to the door motor 142, and, based on the detection, the station control unit 400 can determine that the door 141 blocks the dust passage hole 121*a*, and stop the operation of the door motor 142.

Therefore, in the additional dust collecting step, the operation of the dust collecting motor 191 can be maintained in a state in which the dust passage hole 121*a* is blocked.

In this case, the dust or the like remaining on the dust bin 220 and the dust bin guide surface 122 can be sucked into the dust collecting part 170 through the bypass passage by the negative pressure generated by the operation of the dust collecting motor 191.

According to the second embodiment of the present disclosure, since remaining dust can be sucked while lowering the rotation speed of the dust collecting motor 191, there is an advantage of increasing energy efficiency.

Meanwhile, in the additional dust collecting step, the station control unit 400 can stop the dust collecting motor 191 when the additional dust collecting time ts2 has elapsed.

In this case, the station control unit 400 can gradually decrease the rotation speed of the dust collecting motor 191 from the additional dust collecting speed Ws2 for the predetermined suction reduction time tsd. For example, the station control unit 400 can gradually decrease the rotation speed of the dust collecting motor 191 from the additional dust collecting speed Ws2 for a period of 1 second or more and 3 seconds or less. This has the advantage of increasing the lifetime of the dust collecting motor 191 by protecting the dust collecting motor 191.

On the contrary, the station control unit 400 can immediately cut off the power applied to the dust collecting motor 191. This has the advantage of minimizing the operation time of the dust collecting motor 191 to increase energy efficiency and minimize noise generation.

Meanwhile, FIG. 15 is a view for explaining an operation of controlling each motor over time in a method of controlling a cleaner station according to a third embodiment of the present disclosure.

The method of controlling the cleaner station according to the third embodiment of the present disclosure includes a coupling checking step, a dust bin fixing step, a cover opening step, a door opening step, a dust collecting step, an additional dust collecting step, a door closing checking step, and a fixing release step.

In order to avoid a repeated description, the contents related to the coupling checking step S10, the dust bin fixing step S20, the cover opening step S30, the door opening step S40, the dust collecting step S50, the door closing checking step S70, and the fixation releasing step S80 in the method of controlling a cleaner station according to the first embodiment of the present disclosure can be used to describe the coupling checking step, the dust bin fixing step, the cover opening step, the door opening step, the dust collecting step, the door closing checking step, and the fixing release step according to the third embodiment.

Meanwhile, since the control of the dust collecting motor 191 in the additional dust collecting step of the third embodiment is the same as that in the additional dust collecting step S60 of the first embodiment, the description for the control of the dust collecting motor 191 in the additional dust collecting step S60 can be used to describe that in the additional dust collecting step.

Meanwhile, the control of the door motor 142 in the additional dust collecting step S60 of the first embodiment can be used to describe that in the additional dust collecting step S260 of the third embodiment unless otherwise specified.

In the additional dust collecting step, the station control unit 400 rotates the door 141 while the dust collecting motor 191 is operating, and can change the direction of rotation of the door 141, which can be repeated at least once.

Specifically, in the additional dust collecting step, the door 141 can be reciprocally rotated at least once or more from the open position Po to the flow rate change position Pc. In this case, the number of reciprocating rotations of the door 141 can be set in advance according to embodiments, and the time for reciprocating rotation can be set in advance. For example, in the additional dust collecting step, the door 141 can be reciprocally rotated five times from the open position Po to the flow rate change position Pc. As another example, in the additional dust collecting step, the door 141 can be continuously reciprocally rotated from the open position Po to the flow rate change position Pc for a time of 8 seconds or more and 10 seconds or less.

With this configuration, the flow rate of air discharged from the dust bin 220 and passing through the dust passage hole 121*a* can continuously change. Therefore, in the present embodiment, an effect similar to dusting the dust bin 220 can be occurred, and the effect of removing the dust and hair that can stick to the dust bin 220 or remain stuck in the cyclone filter 219 can be improved.

Meanwhile, in the additional dust collecting step of the third embodiment, the station control unit 400 operates the door motor 142 in the reverse direction after the set reciprocating rotation of the door 141 is ended to rotate the door 141 to the closed position Ps.

With this configuration, in the additional dust collecting step S260, after the reciprocating rotation of the door 141 is ended, the operation of the dust collecting motor 191 can be maintained in a state in which the door 141 blocks the dust passage hole 121*a*.

In this case, the dust or the like remaining on the dust bin 220 and the dust bin guide surface 122 can be sucked into the dust collecting part 170 through the bypass passage by the negative pressure generated by the operation of the dust collecting motor 191.

Various embodiments described herein can be implemented in a computer-readable medium using, for example, software, hardware, or some combination thereof. For example, the embodiments described herein can be implemented within one or more of Application Specific Integrated Circuits (ASICs), Digital Signal Processors (DSPs), Digital Signal Processing Devices (DSPDs), Programmable Logic Devices (PLDs), Field Programmable Gate Arrays (FPGAs), processors, controllers, micro-controllers, microprocessors, other electronic units designed to perform the functions described herein, or a selective combination thereof. In some cases, such embodiments are implemented by the controller. That is, the controller is a hardware-embedded processor executing the appropriate algorithms (e.g., flowcharts) for performing the described functions and thus has sufficient structure. Also, the embodiments such as procedures and functions can be implemented together with separate software modules each of which performs at least one of functions and operations. The software codes can be implemented with a software application written in any suitable programming language. Also, the software codes can be stored in the memory and executed by the controller, thus making the controller a type of special purpose controller specifically configured to carry out the described functions and algorithms. Thus, the components shown in the drawings have sufficient structure to implement the appropriate algorithms for performing the described functions.

The present invention being thus described, it will be obvious that the same can be varied in many ways. Such variations are not to be regarded as a departure from the spirit and scope of the present invention, and all such modifications as would be obvious to one skilled in the art are intended to be included within the scope of the following claims.

The invention claimed is:

1. A cleaner station configured to be coupled to a cleaner, the cleaner including a dust bin and a discharge cover that selectively opens and closes the dust bin to remove a foreign substance inside the dust bin, the cleaner station comprising:

a housing;

a coupling part disposed on the housing, the coupling part including a coupling surface to which at least a part of the cleaner is coupled;

a dust collection part accommodated inside the housing below the coupling part, the dust collection part being configured to collect dust from inside the dust bin of the cleaner;

a dust collecting motor accommodated inside the housing below the dust collecting part, the dust collecting motor being configured to generate a suction force to suck the dust from inside the dust bin; and a door hingedly coupled to the housing, wherein rotation of the door causes the discharge cover to selectively open and close a dust passage hole on the coupling surface.

2. The cleaner station of claim 1, wherein the door is configured to rotate to change an open area of the dust passage hole during the operation of the dust collecting motor.

3. The cleaner station of claim 1, wherein the door is configured to rotate to open the dust passage hole before the operation of the dust collecting motor starts.

4. The cleaner station of claim 1, further comprising a door motor configured to provide rotational force for rotating the door, wherein the door motor is configured to operate in a state in which the dust collecting motor is operated for a predetermined dust collecting time.

5. The cleaner station of claim 4, wherein the dust collecting motor is configured to operate at a predetermined dust collecting speed and to maintain the predetermined dust collecting speed when the door motor is operated.

6. The cleaner station of claim 1, wherein the door is configured to rotate during the operation of the dust collecting motor, and to change a direction of the rotation at least once.

7. The cleaner station of claim 1, wherein while the dust collecting motor is operated at a predetermined dust collecting speed, a flow rate of air passing through the dust passage hole is changed.

8. The cleaner station of claim 1, wherein the door blocks the dust passage hole while operation of the dust collecting motor is maintained.

9. The cleaner station of claim 1, wherein the door is configured to rotate within an angle range of 10 degrees to 90 degrees from a closed position of the door, and wherein in the closed position of the door, the dust passage hole is blocked.

10. The cleaner station of claim 1, wherein the door is configured to open at least a part of the dust passage hole and then close the dust passage hole again when a predetermined suction end time has elapsed after the operation of the dust collecting motor is ended.

* * * * *